US008377526B2

(12) United States Patent
Mohan et al.

(10) Patent No.: US 8,377,526 B2
(45) Date of Patent: Feb. 19, 2013

(54) COMPOSITIONS CONTAINING EXPANDABLE MICROSPHERES AND AN IONIC COMPOUND, AS WELL AS METHODS OF MAKING AND USING THE SAME

(75) Inventors: Krishna K. Mohan, Mason, OH (US); Cynthia A. Goliber, Phoenixville, PA (US); Yaoliang Hong, Mason, OH (US); Peter M. Froass, Mason, OH (US); Herbert Young, Cincinnati, OH (US); Dennis W. Anderson, Goshen, OH (US); Richard D. Faber, Memphis, TN (US)

(73) Assignee: International Paper Company, Memphis, TN (US)

( * ) Notice: Subject to any disclaimer, the term of this patent is extended or adjusted under 35 U.S.C. 154(b) by 0 days.

(21) Appl. No.: 13/190,693

(22) Filed: Jul. 26, 2011

(65) Prior Publication Data

US 2011/0277949 A1 Nov. 17, 2011

Related U.S. Application Data

(62) Division of application No. 12/383,667, filed on Mar. 26, 2009, now Pat. No. 8,030,365, which is a division of application No. 11/374,239, filed on Mar. 13, 2006, now Pat. No. 8,034,847.

(60) Provisional application No. 60/660,703, filed on Mar. 11, 2005.

(51) Int. Cl.
*D21H 11/00* (2006.01)
*D21H 13/00* (2006.01)
*D21H 15/00* (2006.01)

(52) U.S. Cl. ..... 428/34.2; 162/100; 162/164.1; 521/65; 521/76

(58) Field of Classification Search ..... 162/158, 162/135, 204, 100, 164.1; 521/65, 76; 428/34.2
See application file for complete search history.

(56) References Cited

U.S. PATENT DOCUMENTS

| | | | |
|---|---|---|---|
| 1,117,113 | A | 11/1914 | Wagg |
| 1,892,873 | A | 1/1933 | Darrah |
| 1,500,207 | A | 7/1942 | Shaw |
| 2,800,458 | A | 7/1957 | Green |
| 3,200,033 | A | 8/1965 | Grossteinbeck et al. |
| 3,293,114 | A | 12/1966 | Kenaga et al. |
| 3,357,322 | A | 12/1967 | Gill |
| 3,359,130 | A | 12/1967 | Goldman |
| 3,468,467 | A | 9/1969 | Amberg |
| 3,515,569 | A | 6/1970 | Walters et al. |
| 3,533,908 | A | 10/1970 | Hoogsteen |
| 3,546,060 | A | 12/1970 | Hoppe et al. |
| 3,556,497 | A | 1/1971 | Grenfell |
| 3,556,934 | A | 1/1971 | Meyer |
| 3,611,583 | A | 10/1971 | Anderson et al. |
| 3,615,972 | A | 10/1971 | Morehouse |
| 3,626,045 | A | 12/1971 | Woodings |
| 3,703,394 | A | 11/1972 | Hemming et al. |
| 3,740,359 | A | 6/1973 | Garner |
| 3,779,951 | A | 12/1973 | Streu |
| 3,785,254 | A | 1/1974 | Mann |
| 3,819,463 | A | 6/1974 | Ervin et al. |
| 3,819,470 | A | 6/1974 | Shaw et al. |
| 3,824,114 | A | 7/1974 | Vassiliades et al. |
| 3,842,020 | A | 10/1974 | Garrett |
| 3,864,181 | A | 2/1975 | Wolinski et al. |
| 3,878,038 | A | 4/1975 | Opderbeck et al. |
| 3,914,360 | A | 10/1975 | Gunderman et al. |
| 3,936,890 | A | 2/1976 | Oberstein |
| 3,941,634 | A | 3/1976 | Nisser |
| 3,945,956 | A | 3/1976 | Garner |
| 3,998,618 | A | 12/1976 | Kreick et al. |
| 4,002,586 | A | 1/1977 | Wessling et al. |
| 4,006,273 | A | 2/1977 | Wolinski et al. |
| 4,022,965 | A | 5/1977 | Goheen et al. |
| 4,040,900 | A | 8/1977 | Mazzarella et al. |
| 4,044,176 | A | 8/1977 | Wolinski et al. |
| 4,051,277 | A | 9/1977 | Wilkinson et al. |
| 4,056,501 | A | 11/1977 | Gibbs et al. |
| 4,075,136 | A | 2/1978 | Schaper |
| 4,108,806 | A | 8/1978 | Cohrs et al. |
| 4,133,688 | A | 1/1979 | Sack |
| 4,166,894 | A | 9/1979 | Schaper |
| 4,174,417 | A | 11/1979 | Rydell |
| 4,179,546 | A | 12/1979 | Garner et al. |
| 4,233,325 | A | 11/1980 | Slangan et al. |
| 4,237,171 | A | 12/1980 | Laage et al. |
| 4,241,125 | A | 12/1980 | Canning et al. |
| 4,242,411 | A | 12/1980 | Costa, Jr. et al. |
| 4,243,480 | A | 1/1981 | Hernandez et al. |
| 4,268,615 | A | 5/1981 | Yonezawa |

(Continued)

FOREIGN PATENT DOCUMENTS

| | | |
|---|---|---|
| CN | 1417390 | 5/2003 |
| CN | 101392473 | 3/2009 |

(Continued)

OTHER PUBLICATIONS

Smook, Gary A., Handbook for Pulp and Paper Technologists, 2nd ed, Angus Wilde Publications, 1992, pp. 285 and 292-295.
Tappi/May 1972, vol. 55, No. 5, p. 770-771.
Tappi/Dec. 1973, vol. 56, No. 12, p. 158-160.
"The Use of Microspheres to Improve Paper Properties", by Soderberg, Paper Technology, Aug. 1989, pp. VIII/17-VII/21.
"The Application of Microspheres for the Production of High Bulk Papers", by M. Baumeister, Das Papier, vol. 26, No. 10A: 716-720 (1972).
"Microspheres find use as fiber replacement in low-density board", by David O. Bowen, Pulp Paper Nov. 1976, p. 126-127.

(Continued)

*Primary Examiner* — Randy Gulakowski
*Assistant Examiner* — Kara Boyle
(74) *Attorney, Agent, or Firm* — Thomas W. Barnes, III; John K. Pike

(57) ABSTRACT

This invention relates to composition containing expandable microspheres and at least one ionic compound and having a zeta potential that is greater than or equal to zero mV at a pH of about 9.0 or less at an ionic strength of from $10^{-6}$ M to 0.1M, as well as methods of making and using the composition.

27 Claims, 6 Drawing Sheets

U.S. PATENT DOCUMENTS

| | | | |
|---|---|---|---|
| 4,279,794 | A | 7/1981 | Dumas |
| 4,323,602 | A | 4/1982 | Parker |
| 4,324,753 | A | 4/1982 | Gill |
| 4,344,787 | A | 8/1982 | Beggs et al. |
| 4,385,961 | A | 5/1983 | Svending et al. |
| 4,431,481 | A | 2/1984 | Drach et al. |
| 4,435,344 | A | 3/1984 | Iioka |
| 4,448,638 | A | 5/1984 | Klowak |
| 4,451,585 | A | 5/1984 | Andersson |
| 4,464,224 | A | 8/1984 | Matolcsy |
| 4,477,518 | A | 10/1984 | Cremona et al. |
| 4,482,429 | A | 11/1984 | Klowak |
| 4,483,889 | A | 11/1984 | Andersson |
| 4,496,427 | A | 1/1985 | Davison |
| 4,548,349 | A | 10/1985 | Tunberg |
| 4,581,285 | A | 4/1986 | Mahefkey, Jr. |
| 4,617,223 | A | 10/1986 | Hiscock et al. |
| 4,619,734 | A | 10/1986 | Andersson |
| 4,722,943 | A | 2/1988 | Melber et al. |
| 4,777,930 | A | 10/1988 | Hartz |
| 4,781,243 | A | 11/1988 | DeVogel et al. |
| 4,829,094 | A | 5/1989 | Melber et al. |
| 4,836,400 | A | 6/1989 | Chaffey et al. |
| 4,865,875 | A | 9/1989 | Kellerman |
| 4,885,203 | A | 12/1989 | Wakat |
| 4,898,752 | A | 2/1990 | Cavagna et al. |
| 4,902,722 | A | 2/1990 | Melber |
| 4,946,737 | A | 8/1990 | Lindeman et al. |
| 4,952,628 | A | 8/1990 | Blatz |
| 4,959,395 | A | 9/1990 | Janda |
| 4,977,004 | A | 12/1990 | Bettle, III et al. |
| 4,982,722 | A | 1/1991 | Wyatt |
| 4,986,882 | A | 1/1991 | Mackey et al. |
| 4,988,478 | A | 1/1991 | Held |
| 5,000,788 | A | 3/1991 | Stotler |
| 5,029,749 | A | 7/1991 | Aloisi |
| 5,049,235 | A | 9/1991 | Barcus et al. |
| 5,092,485 | A | 3/1992 | Lee |
| 5,096,650 | A | 3/1992 | Renna |
| 5,101,600 | A | 4/1992 | Morris et al. |
| 5,102,948 | A | 4/1992 | Deguchi et al. |
| 5,125,996 | A | 6/1992 | Campbell et al. |
| 5,126,192 | A | 6/1992 | Chellis et al. |
| 5,132,061 | A | 7/1992 | Lindeman et al. |
| 5,139,538 | A | 8/1992 | Morris et al. |
| 5,145,107 | A | 9/1992 | Silver et al. |
| 5,155,138 | A | 10/1992 | Lundqvist |
| 5,160,789 | A | 11/1992 | Barcus et al. |
| 5,209,953 | A | 5/1993 | Grupe et al. |
| 5,219,875 | A | 6/1993 | Sherba et al. |
| 5,225,123 | A | 7/1993 | Torobin |
| 5,226,585 | A | 7/1993 | Varano |
| 5,242,545 | A | 9/1993 | Bradway et al. |
| 5,244,541 | A | 9/1993 | Minton |
| 5,266,250 | A | 11/1993 | Kroyer |
| 5,271,766 | A | 12/1993 | Koutlakis et al. |
| 5,296,024 | A | 3/1994 | Hutchenson |
| 5,342,649 | A | 8/1994 | Sarokin |
| 5,360,420 | A | 11/1994 | Cook et al. |
| 5,360,825 | A | 11/1994 | Noguchi et al. |
| 5,363,982 | A | 11/1994 | Sadlier |
| 5,370,814 | A | 12/1994 | Salyer |
| 5,397,759 | A | 3/1995 | Torobin |
| 5,417,753 | A | 5/1995 | Hutchenson |
| 5,424,519 | A | 6/1995 | Salee |
| 5,443,899 | A | 8/1995 | Barcus et al. |
| 5,454,471 | A | 10/1995 | Norvell |
| 5,464,622 | A | 11/1995 | Mehta et al. |
| 5,477,917 | A | 12/1995 | Salyer |
| 5,478,988 | A | 12/1995 | Hughes et al. |
| 5,484,815 | A | 1/1996 | Petersen et al. |
| 5,490,631 | A | 2/1996 | Iioka et al. |
| 5,499,460 | A | 3/1996 | Bryant et al. |
| 5,514,429 | A | 5/1996 | Kamihgaraguchi et al. |
| 5,520,103 | A | 5/1996 | Zielinski et al. |
| 5,531,728 | A | 7/1996 | Lash |
| 5,536,756 | A | 7/1996 | Kida et al. |
| 5,585,119 | A | 12/1996 | Petersen et al. |
| 5,593,680 | A | 1/1997 | Bara et al. |
| 5,601,744 | A | 2/1997 | Baldwin |
| 5,629,364 | A | 5/1997 | Malmbom et al. |
| 5,637,389 | A | 6/1997 | Colvin et al. |
| 5,649,478 | A | 7/1997 | Chadha |
| 5,662,761 | A | 9/1997 | Middelman et al. |
| 5,662,773 | A | 9/1997 | Frederick et al. |
| 5,667,637 | A | 9/1997 | Jewell et al. |
| 5,674,590 | A | 10/1997 | Anderson et al. |
| 5,685,068 | A | 11/1997 | Bankestrom et al. |
| 5,698,074 | A | 12/1997 | Barcus et al. |
| 5,698,688 | A | 12/1997 | Smith et al. |
| 5,700,560 | A | 12/1997 | Kotani et al. |
| H1704 | H | 1/1998 | Wallajapet et al. |
| 5,705,242 | A | 1/1998 | Andersen et al. |
| 5,731,080 | A | 3/1998 | Cousin et al. |
| 5,759,624 | A | 6/1998 | Neale et al. |
| 5,785,817 | A | 7/1998 | Tan et al. |
| 5,792,398 | A | 8/1998 | Andersson |
| 5,800,676 | A | 9/1998 | Koike et al. |
| 5,856,389 | A | 1/1999 | Kostrzewski et al. |
| 5,861,214 | A | 1/1999 | Kitano et al. |
| 5,880,435 | A | 3/1999 | Bostic |
| 5,884,006 | A | 3/1999 | Frohlich et al. |
| 5,938,825 | A | 8/1999 | Gaglani et al. |
| 5,952,068 | A | 9/1999 | Neale et al. |
| 5,965,109 | A | 10/1999 | Lohrmann |
| 6,007,320 | A | 12/1999 | Froese et al. |
| 6,034,081 | A | 3/2000 | Whittemore et al. |
| 6,042,936 | A | 3/2000 | Kempf |
| 6,133,170 | A | 10/2000 | Suenaga et al. |
| 6,134,952 | A | 10/2000 | Garver et al. |
| 6,146,494 | A | 11/2000 | Seger et al. |
| 6,225,361 | B1 | 5/2001 | Nakajima |
| 6,228,200 | B1 | 5/2001 | Willis et al. |
| 6,235,394 | B1 | 5/2001 | Shimazawa et al. |
| 6,248,799 | B1 | 6/2001 | Peretti et al. |
| 6,254,725 | B1 | 7/2001 | Lau et al. |
| 6,267,837 | B1 | 7/2001 | Mitchell et al. |
| 6,308,883 | B1 | 10/2001 | Schmelzer et al. |
| 6,352,183 | B1 | 3/2002 | Kristiansen et al. |
| 6,361,651 | B1 | 3/2002 | Sun |
| 6,379,497 | B1 | 4/2002 | Sandstrom et al. |
| 6,387,492 | B2 | 5/2002 | Soane et al. |
| 6,391,154 | B1 | 5/2002 | Nygård et al. |
| 6,391,943 | B2 | 5/2002 | Sarma et al. |
| 6,406,592 | B2 | 6/2002 | Leskela et al. |
| 6,454,989 | B1 | 9/2002 | Neely et al. |
| 6,455,156 | B1 | 9/2002 | Tanaka et al. |
| 6,471,824 | B1 | 10/2002 | Jewell |
| 6,497,790 | B2 | 12/2002 | Mohan et al. |
| 6,506,282 | B2 | 1/2003 | Hu et al. |
| 6,509,384 | B2 | 1/2003 | Kron et al. |
| 6,531,183 | B1 | 3/2003 | Cason et al. |
| 6,537,680 | B1 | 3/2003 | Norlander et al. |
| 6,579,414 | B2 | 6/2003 | Jewell |
| 6,579,415 | B2 | 6/2003 | Jewell |
| 6,582,557 | B2 | 6/2003 | Jewell |
| 6,582,633 | B2 | 6/2003 | Elfving et al. |
| 6,592,712 | B2 | 7/2003 | Koukoulas et al. |
| 6,592,717 | B2 | 7/2003 | Jewell |
| 6,592,983 | B1 | 7/2003 | Carson et al. |
| 6,613,810 | B1 | 9/2003 | Ejiri et al. |
| 6,617,364 | B2 | 9/2003 | Soane et al. |
| 6,630,232 | B1 | 10/2003 | Muser et al. |
| 6,701,637 | B2 | 3/2004 | Lindsay et al. |
| 6,740,373 | B1 | 5/2004 | Swoboda et al. |
| 6,802,938 | B2 | 10/2004 | Mohan et al. |
| 6,846,529 | B2 | 1/2005 | Mohan et al. |
| 6,864,297 | B2 | 3/2005 | Nutt et al. |
| 6,866,906 | B2 | 3/2005 | Williams et al. |
| 6,890,636 | B2 | 5/2005 | Danver |
| 6,893,473 | B2 | 5/2005 | Neogi et al. |
| 6,919,111 | B2 | 7/2005 | Swoboda et al. |
| 6,984,347 | B2 | 1/2006 | Masuda et al. |
| 7,018,509 | B2 | 3/2006 | Kilgannon et al. |
| 7,033,527 | B2 | 4/2006 | Kim et al. |
| 7,070,679 | B2 | 7/2006 | Cason et al. |
| 7,192,989 | B2 | 3/2007 | Svedberg et al. |

| | | | | |
|---|---|---|---|---|
| 7,202,284 | B1 | 4/2007 | Limerkens et al. | |
| 7,230,036 | B2 | 6/2007 | Glorioso, Jr. et al. | |
| 7,232,607 | B2 | 6/2007 | Satake et al. | |
| 7,252,882 | B2 | 8/2007 | Satake et al. | |
| 7,253,217 | B2 | 8/2007 | Sohal | |
| 7,291,239 | B2 | 11/2007 | Polance et al. | |
| 7,335,279 | B2 | 2/2008 | Mohan et al. | |
| 7,361,399 | B2 | 4/2008 | Song et al. | |
| 7,482,046 | B2 | 1/2009 | Williams et al. | |
| 7,682,486 | B2 | 3/2010 | Mohan et al. | |
| 7,740,740 | B2 | 6/2010 | Mohan et al. | |
| 7,790,251 | B2 | 9/2010 | Williams et al. | |
| 7,943,011 | B2 | 5/2011 | Reed et al. | |
| 8,030,365 | B2 | 10/2011 | Mohan et al. | |
| 8,034,847 | B2 | 10/2011 | Mohan et al. | |
| 2001/0024716 | A1 | 9/2001 | Chen et al. | |
| 2001/0038893 | A1 | 11/2001 | Mohan et al. | |
| 2001/0044477 | A1 | 11/2001 | Soane et al. | |
| 2001/0046574 | A1 | 11/2001 | Curtis | |
| 2002/0074100 | A1 | 6/2002 | Yeh et al. | |
| 2002/0096277 | A1 | 7/2002 | Lau et al. | |
| 2002/0104632 | A1* | 8/2002 | Jimenez et al. | 162/158 |
| 2002/0148832 | A1 | 10/2002 | Breining et al. | |
| 2002/0152630 | A1 | 10/2002 | Lindsay et al. | |
| 2003/0003268 | A1* | 1/2003 | Williams et al. | 428/124 |
| 2003/0008931 | A1 | 1/2003 | Soane et al. | |
| 2003/0008932 | A1 | 1/2003 | Soane et al. | |
| 2003/0065041 | A1* | 4/2003 | Keiser et al. | 516/82 |
| 2003/0152724 | A1 | 8/2003 | Swoboda et al. | |
| 2003/0175497 | A1 | 9/2003 | Kobe et al. | |
| 2003/0213544 | A1 | 11/2003 | Hesch | |
| 2004/0030080 | A1 | 2/2004 | Chang et al. | |
| 2004/0052989 | A1 | 3/2004 | Mohan et al. | |
| 2004/0065423 | A1 | 4/2004 | Swerin et al. | |
| 2004/0065424 | A1 | 4/2004 | Mohan et al. | |
| 2004/0099391 | A1 | 5/2004 | Ching et al. | |
| 2004/0123966 | A1 | 7/2004 | Altman et al. | |
| 2004/0157057 | A1 | 8/2004 | Tasaki et al. | |
| 2004/0170836 | A1 | 9/2004 | Bond et al. | |
| 2004/0197500 | A9 | 10/2004 | Swoboda et al. | |
| 2004/0209023 | A1 | 10/2004 | Swoboda et al. | |
| 2004/0221976 | A1 | 11/2004 | Williams et al. | |
| 2004/0238138 | A1 | 12/2004 | Ishizaki et al. | |
| 2004/0249005 | A1 | 12/2004 | Kron et al. | |
| 2005/0031851 | A1 | 2/2005 | Depres | |
| 2005/0079352 | A1 | 4/2005 | Glorioso et al. | |
| 2005/0098286 | A1 | 5/2005 | Williams et al. | |
| 2005/0112305 | A1 | 5/2005 | Swoboda et al. | |
| 2005/0133183 | A1 | 6/2005 | Mohan et al. | |
| 2005/0221073 | A1 | 10/2005 | Liou | |
| 2006/0000569 | A1 | 1/2006 | Kron et al. | |
| 2006/0057356 | A1 | 3/2006 | Yamamura et al. | |
| 2006/0057365 | A1 | 3/2006 | Swoboda et al. | |
| 2006/0060317 | A1* | 3/2006 | Roding et al. | 162/135 |
| 2006/0063000 | A1 | 3/2006 | Tokumura et al. | |
| 2006/0099247 | A1 | 5/2006 | Cantwell et al. | |
| 2006/0102307 | A1 | 5/2006 | Kron et al. | |
| 2006/0131362 | A1 | 6/2006 | Bergenudd et al. | |
| 2006/0173087 | A1 | 8/2006 | Hyde et al. | |
| 2006/0185808 | A1 | 8/2006 | Nguyen | |
| 2006/0207735 | A1 | 9/2006 | Blanz et al. | |
| 2006/0231227 | A1 | 10/2006 | Williams et al. | |
| 2006/0235095 | A1 | 10/2006 | Leberfinger et al. | |
| 2006/0235096 | A1 | 10/2006 | Luisi | |
| 2007/0043130 | A1 | 2/2007 | Svedberg et al. | |
| 2007/0044929 | A1 | 3/2007 | Mohan et al. | |
| 2007/0142485 | A1 | 6/2007 | Nordin et al. | |
| 2007/0154711 | A1 | 7/2007 | Masuda et al. | |
| 2007/0208093 | A1 | 9/2007 | Nordin et al. | |
| 2007/0256805 | A1 | 11/2007 | Reed et al. | |
| 2007/0287776 | A1 | 12/2007 | Nordin et al. | |
| 2008/0017338 | A1 | 1/2008 | Nordin et al. | |
| 2008/0163992 | A1 | 7/2008 | Mohan et al. | |
| 2008/0171186 | A1 | 7/2008 | Mohan et al. | |
| 2008/0314539 | A1 | 12/2008 | Williams et al. | |
| 2009/0020247 | A1 | 1/2009 | Swerin et al. | |
| 2009/0246459 | A1 | 10/2009 | Williams et al. | |
| 2009/0280328 | A1 | 11/2009 | Masuda et al. | |
| 2010/0032114 | A1 | 2/2010 | Mohan et al. | |
| 2010/0032115 | A1 | 2/2010 | Mohan et al. | |
| 2010/0051220 | A1 | 3/2010 | Hong et al. | |
| 2010/0252216 | A1 | 10/2010 | Mohan et al. | |
| 2011/0036526 | A1 | 2/2011 | Williams et al. | |
| 2011/0277949 | A1 | 11/2011 | Mohan et al. | |

FOREIGN PATENT DOCUMENTS

| | | |
|---|---|---|
| DE | 4312854 | 10/1994 |
| EP | 0031161 A1 | 12/1980 |
| EP | 102335 | 3/1984 |
| EP | 0056219 | 3/1985 |
| EP | 0049672 | 4/1985 |
| EP | 0041054 | 10/1985 |
| EP | 112807 | 11/1987 |
| EP | 320473 | 6/1989 |
| EP | 0190788 | 4/1990 |
| EP | 0432355 | 6/1991 |
| EP | 0629741 | 6/1994 |
| EP | 0596750 | 9/1994 |
| EP | 0666368 | 2/1995 |
| EP | 0700237 | 3/1996 |
| EP | 0651696 | 8/1998 |
| EP | 0751866 | 4/1999 |
| EP | 1050622 | 11/2000 |
| EP | 1101809 | 5/2001 |
| EP | 0484893 | 6/2001 |
| EP | 1531198 | 5/2005 |
| EP | 1275688 | 12/2005 |
| EP | 1712585 | 10/2006 |
| EP | 1852552 | 11/2007 |
| GB | 0786543 | 11/1957 |
| GB | 0903416 | 8/1962 |
| GB | 1311556 | 3/1973 |
| GB | 1373788 | 11/1974 |
| GB | 1401675 | 7/1975 |
| GB | 1412857 | 11/1975 |
| GB | 1533434 | 11/1978 |
| GB | 2015611 | 9/1979 |
| JP | 55023126 | 2/1980 |
| JP | 56030439 | 3/1981 |
| JP | 59227933 | 12/1984 |
| JP | 2056240 | 2/1990 |
| JP | 4059674 | 2/1992 |
| JP | 06157215 | 6/1994 |
| JP | 06329834 | 11/1994 |
| JP | 10219596 | 8/1998 |
| JP | 11209504 | 8/1999 |
| JP | 2000273235 | 10/2000 |
| JP | 2005001357 | 1/2005 |
| JP | 2005179685 | 7/2005 |
| JP | 2006063509 | 3/2006 |
| WO | 8806916 | 9/1988 |
| WO | 9222191 | 12/1992 |
| WO | 9323614 | 11/1993 |
| WO | 9423952 | 10/1994 |
| WO | 9520479 | 8/1995 |
| WO | 9526441 | 10/1995 |
| WO | 9719127 | 5/1997 |
| WO | 2004101888 | 11/2004 |

OTHER PUBLICATIONS

"Foams on the Cutting Edge", by Ray Erikson, Jan. 1999.

E. Strazdins in The Sizing of Paper, Second Edition, cited by W. F. Reynolds, TAPPI Press, 1989, pp. 1-31.

Sindall, R. W., "Paper Technology. An Elementary Manual on the Manufacture, Physical Qualities and Chemical Constituents of Paper and Paper-Making Fibres," 1906, Charles Griffin and Company, limited, pp. 1-5.

C.E. Farley and R.B. Wasser in The Sizing of Paper, Second Edition, edited by W. F. Reynolds, TAPPI Press, 1989, pp. 51.62.

R. Wessling, Science and Technology of Polymer Colloids, NATO ASI Series E: Applied Sciences, No. 68, p. 393 (1983).

Maf Ahmad, Thermoplastic Microspheres As Foaming Agents for Wood Plastic Comp, Presented at WPC 2004 Conference, Vienna, Austria (http://www.expancel.com/english/bulletin/files/WPC2004PaperMA2.pdf).

Samel et al., Expandable microspheres incorporated in a PDMS matrix: a novel thermal composite actuator for liquid handling in microfluidic applications, Transducers, Solid-State Sensors, Actuators and Microsystems, 12th International Conference, vol. 2, Issue 8-12, Jun. 2003, pp. 1558-1561.
Hollow Microsperes, Chemical Engineering Technology, vol. 27, issue 8, pp. 829-837, Published Online: Aug. 2, 2004.
G.A. Smook, Handbook for Pulp and Paper Technologists, 1992, Angus Wilde Publications.
Moulton, Glen E. "Chemical Reactions: Ionic, Covalent, and Polar Covalent Bonds." The Complete Idiot's Guide to Biology 2004. Penguin Group.
Akzo Nobel Expancel 551 DE 20 d60 Dry Expanded Microspheres, Material Data Sheet from www.matweb.com/search/DataSheet.aspx, Pub Date Oct. 2006.
"Xpancel.RTM.", An Introduction, a publication from Expancel, Box 13000S0850-3, Sundsvall, Sweden, Date 1998, Relevant pages of publication—All.
Expancel .RTM. Expandable Microspheres in Paper and Board, by Mark Lunabba, KemaNord Plast AB, Sector Microspheres, Box 13000, S-850 13 Sundsvall, Sweden, 1984, p. 250, 251, 253.
"Expandable Microspheres in Board", World Pulp Paper Technology, pp. 143-145. cited by other, London Sterling Publ. Group, yearly issue 1995-1996.
Yasuhiro Kawaguchi et al., Synthesis and properties of thermoplastic expandable microspheres: The relation between crosslinking density and expandable property, Journal of Applied Polymer Science, vol. 93, 2004 Issue 2, pp. 505-512.

* cited by examiner

AVERAGE DIAMETERS ( MICRONS )

| | 820 SLU 40 | 820 SLU 80 | 642 SLX 80 |
|---|---|---|---|
| BEFORE | 11.7 ± 5.6 | 17.9 ± 7.5 | 19.2 ± 8.3 |
| AFTER | 12.6 ± 6.4 | 19.1 ± 9.0 | 19.7 ± 9.5 |

PSD NOT CHANGED SUBSTANTIALLY
MINIMAL HETEROGENEOUS AGGREGATION

COMPOSITIONS CONTAINING EXPANDABLE MICROSPHERES AND AN IONIC COMPOUND, AS WELL AS METHODS OF MAKING AND USING THE SAME

This application claims the benefit of U.S. provisional application Ser. No. 60/660,703, filed Mar. 11, 2005, entitled "COMPOSITIONS CONTAINING EXPANDABLE MICROSPHERES AND AN IONIC COMPOUND, AS WELL AS METHODS OF MAKING AND USING THE SAME", which is hereby incorporated, in its entirety, herein by reference.

FIELD OF THE INVENTION

This invention relates to compositions containing expandable microspheres and at least one ionic compound and having a zeta potential that is greater than or equal to zero mV at a pH of about 9.0 or less at an ionic strength of from $10^{-6}$ M to 0.1M, as well as methods of making and using the composition.

BACKGROUND OF THE INVENTION

The amount of costly cellulose fibers present in a paper substrate, in part, determines the density of the substrate. Therefore, large amounts of costly cellulose fibers present in a paper substrate produce a more dense substrate at high cost, while low amounts of cellulose fibers present in a paper substrate produce a less dense substrate at low cost. Reducing the density of a coated and/or uncoated paper product, board, and/or substrate, inevitably leads to reduced production costs thereof. This is true in all paper substrate production and uses thereof. This is especially true, for example, in paper substrates used in envelopes, folding carton, as well as other packaging, applications. Substrates used in such as envelope and packaging applications have specified thickness or caliper.

By reducing the density of the paper substrate at a target caliper, less cellulose fibers are thereby required to achieve the target caliper. In addition to a reduction in production costs, there is a production efficiency that is appreciated and realized when a paper substrate's density is reduced. This production efficiency is due, in part, to a reduction in drying requirements (e.g. time, labor, capital, etc) of the paper substrate during production.

Examples of reducing density of the base paper substrate include the use of:

1) multi-ply machines with bulky fibers, such as BCTMP and other mechanical fibers in the center plies of paperboard;
2) extended nip press sections for reducing densification during water removal; and
3) alternative calendaring technologies such as hot soft calendaring, hot steel calendaring, steam moisturization, shoe nip calendaring, etc.

However, these potential solutions involve high capital and costs. Thus, they may be economically infeasible.

Still further, even if the above-mentioned costly reduction in density methods are realized, thus producing a paper substrate having a target caliper, the substrate is only useful if such methodologies foster an acceptably smooth and compressible surface of the paper substrate. Presently, there are few potential low-cost solutions to reduce density of a paper substrate having an acceptable smoothness and compressibility so that said substrate has a significant reduction in print mottle and acceptable smoothness.

Low density coated and uncoated paper products, board, and/or substrates are highly desirable from an aesthetic and economic perspective. However, current methodologies produce substrates that have poor print and/or printability quality. Further, acceptable smoothness targets are difficult to attain using conventional methodologies.

One methodology is to address the above problems at lower cost through the use of expandable microspheres in paper substrates. These methodologies, in part, can be found in the following U.S. Pat. Nos. 6,846,529, 6,802,938, 5,856,389, and 5,342,649 and Published Patent Applications: 20040065424, 20040052989, and 20010038893, which are hereby incorporated, in their entirety, herein by reference.

However, such microspheres are found, when applied in the papermaking process, to have relatively low retention in the resultant paper substrate. As a result, the expandable microspheres are lost to the white water and the efficiency of the introduction of expandable microspheres into the resultant paper substrate is low, thereby providing another costly solution to the above-mentioned myriad of costly solutions.

Accordingly, there is still a need for a less costly and more efficient solution to reduce density, increase bulk, and retain the good performance characteristics such as smoothness and print mottle within a paper substrate.

SUMMARY OF THE INVENTION

One aspect of the present invention is a composition containing at least one expandable microsphere and at least one ionic compound. In one embodiment, the composition has a zeta potential that is greater than or equal to zero mV at a pH of about 9.0 or less at an ionic strength of from $10^{-6}$ M to 0.1M. In another embodiment, the ionic compound is at least one compound selected from the group consisting of an organic and inorganic ionic compound. In yet another embodiment, the ionic compound is at least one polyorganic compound. In yet another embodiment, the ionic compound is at least one polyamine compound. In yet another embodiment, the ionic compound is crosslinked, branched, or combinations thereof. In yet another embodiment, ionic compound is at least one polyethyleneimine compound. In yet another embodiment, the ionic compound has a weight average molecular weight that is at least 600 weight average molecular weight. Further embodiments relate to methods of making and using the composition.

In another aspect, the present invention relates to a composition containing at least one expandable microsphere and at least one ionic compound. In one embodiment, the composition has a zeta potential that is greater than or equal to zero mV at a pH of about 9.0 or less at an ionic strength of from $10^{-6}$ M to 0.1M. In another embodiment, the ionic compound is at least one compound selected from the group consisting of an organic and inorganic ionic compound. In yet another embodiment, the ionic compound is cationic. In yet another embodiment, the ionic compound is at least one member selected from the group of alumina and silica. In another embodiment, the ionic compound is a colloid and/or sol containing at least one member selected from the group consisting of silica, alumina, tin oxide, zirconia, antimony oxide, iron oxide, and rare earth metal oxides. Further embodiments relate to methods of making and using the composition.

In another aspect, the present invention relates to a particle containing at least one expandable microsphere and at least one ionic compound. In one embodiment, the composition has a zeta potential that is greater than or equal to zero mV at a pH of about 9.0 or less at an ionic strength of from $10^{-6}$M to 0.1M. In another embodiment, the outside surface of the at least one expandable microsphere is bound to the ionic compound. In another embodiment, the outside surface of the at least one expandable microsphere is non-covalently bound to the ionic compound. In yet another embodiment, the outside surface of at least one expandable microsphere is anionic. In yet another embodiment, the ionic compound is cationic. In another embodiment, the ionic compound is at least one compound selected from the group consisting of an organic and inorganic ionic compound. In yet another embodiment, the ionic compound is at least one polyorganic compound. In yet another embodiment, the ionic compound is at least one polyamine compound. In yet another embodiment, the ionic compound is crosslinked, branched, or combinations thereof. In yet another embodiment, ionic compound is at least one polyethyleneimine compound. In yet another embodiment, the ionic compound has a weight average molecular weight that is at least 600 weight average molecular weight. Further embodiments relate to methods of making and using the composition.

In another aspect, the present invention relates to a particle containing at least one expandable microsphere and at least one ionic compound. In one embodiment, the composition has a zeta potential that is greater than or equal to zero mV at a pH of about 9.0 or less at an ionic strength of from $10^{-6}$ M to 0.1M. In another embodiment, the outside surface of the at least one expandable microsphere is bound to the ionic compound. In another embodiment, the outside surface of the at least one expandable microsphere is non-covalently bound to the ionic compound. In yet another embodiment, the outside surface of at least one expandable microsphere is anionic. In yet another embodiment, the ionic compound is cationic. In another embodiment, the ionic compound is at least one compound selected from the group consisting of an organic and inorganic ionic compound. In yet another embodiment, the ionic compound is cationic. In yet another embodiment, the ionic compound is at least one member selected from the group of alumina and silica. In another embodiment, the ionic compound is a colloid and/or sol containing at least one member selected from the group consisting of silica, alumina, tin oxide, zirconia, antimony oxide, iron oxide, and rare earth metal oxides. Further embodiments relate to methods of making and using the composition.

In yet another aspect, the present invention relates to a method of making the compositions by contacting the at least one expandable microsphere with the at least one ionic compound to form a mixture. In yet another embodiment, the mixture may be further centrifuged to form a first phase comprising at least one ionic compound and a second phase comprising a particle of the present invention.

In yet another aspect, the present invention relates to a method of making the composition by adsorbing at least one ionic compound to at least one expandable microsphere.

In yet another aspect, the present invention related to a coated and/or uncoated paper and/or paperboard substrates containing and made from and/by any of the above and/or below aspects of the invention. Therefore, in one embodiment, the composition of the present invention may contain a plurality of cellulose fibers.

In yet another aspect, the present invention relates to articles and packaging made from the coated and/or uncoated paper and/or paperboard substrates described herein.

In yet another aspect, the present invention relates to substrates, articles and/or packaging containing from 0.1 to 5 wt % of a plurality of expandable microspheres; wherein the substrate, article, and/or package has a Sheffield Smoothness of less than 250 SU as measured by TAPPI test method T 538 om-1 and a scanning $2^{nd}$ cyan print mottle of not more than 6. In one embodiment of the present invention, the substrate, article and/or package may be calendared. In yet another embodiment of the present invention, an outside surface of the expandable microspheres is bound to an ionic compound. In yet another embodiment, the substrate, article, and/or package contains from 0.1 to 3 wt % of a plurality of expandable microspheres. In yet another embodiment, the substrate, article, and/or package contains from 0.1 to 2 wt % of a plurality of expandable microspheres. In yet another embodiment of the present invention, the substrate, article, and/or package contain at least one coating layer. In yet another embodiment of the present invention, the coating layer is made up of at least one top coat and at least one base coat. In yet another embodiment, the substrate, article, and/or package has a Sheffield Smoothness that is less than 250 SU as measured by TAPPI test method T 538 om-1 and a scanning print mottle that is less than 6 after calendaring. In yet another embodiment, the substrate, article, and/or package has a Parker Print Surface Smoothness of from about 1.0 to 0.5 as measured by TAPPI test method T 555 om-99.

In another aspect, the present invention relates to an article or package containing at least one paper or paperboard substrate where at least one substrate contains a web of cellulose fibers and a bulking agent. In one embodiment, the article weighs equal to or less than one ounce. In yet another embodiment, the article has a weight whose difference from 1 ounce is an absolute value that is more than that of a conventional package having the same number of layers.

All of the above aspects and embodiments, including methods of making and using the same are further described in detail below.

DETAILED DESCRIPTION OF THE INVENTION

Figure 1:
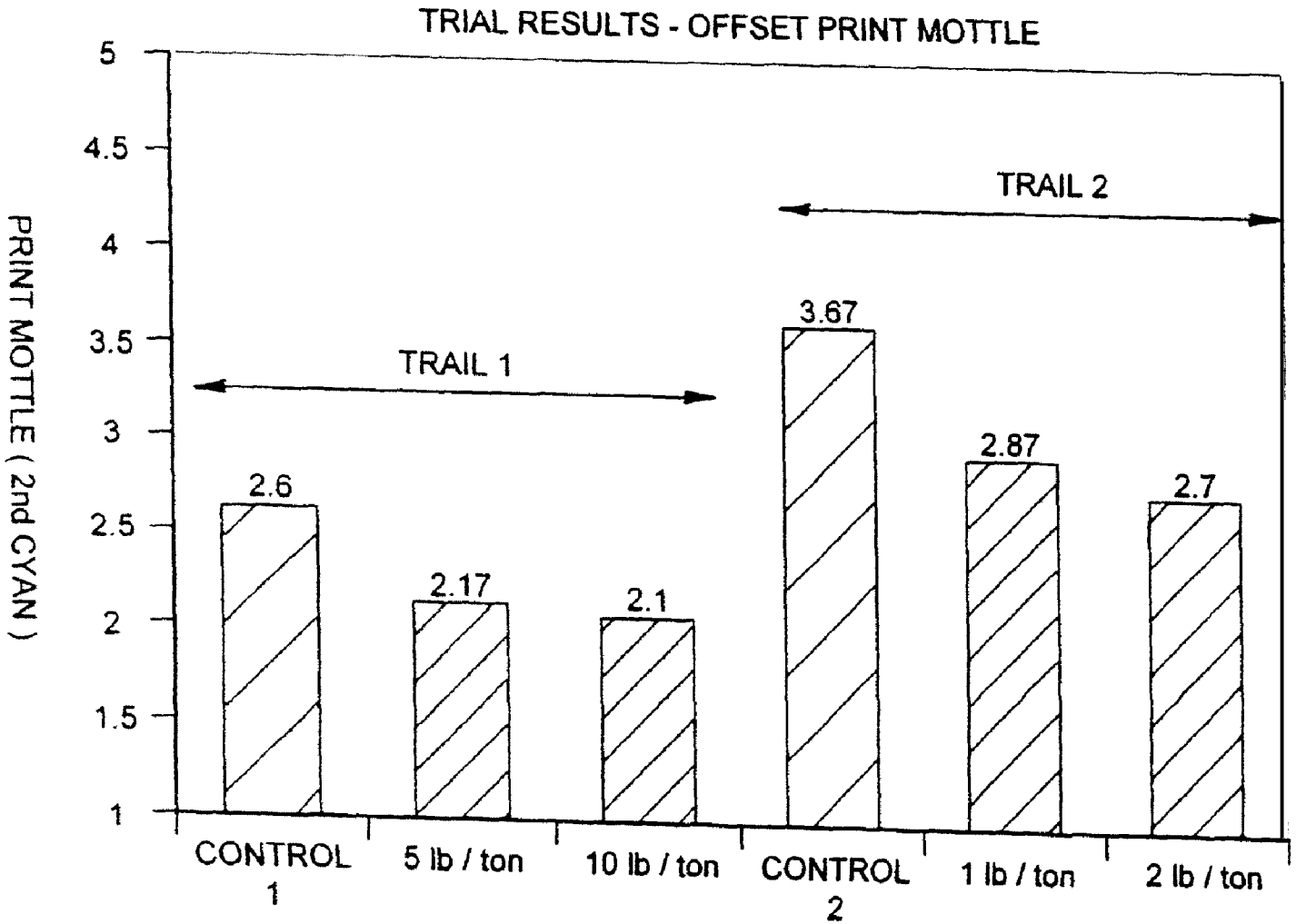
FIG. 1: Plot of print mottle of coated paper substrate vs. amount expandable microspheres within the substrate.
Figure 2:
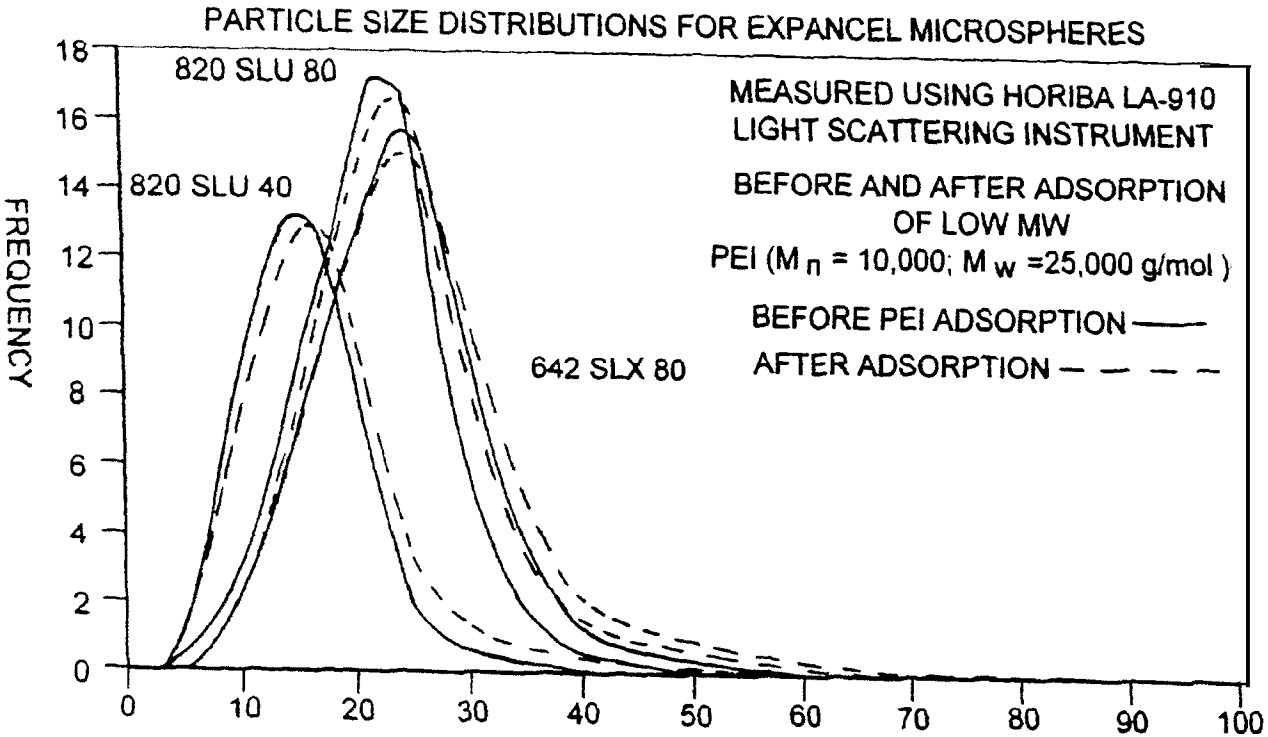
FIG. 2: Plot of the particle size distributions for microspheres before and after adsorption of ionic compound (e.g. PEI) thereto.
Figure 3:
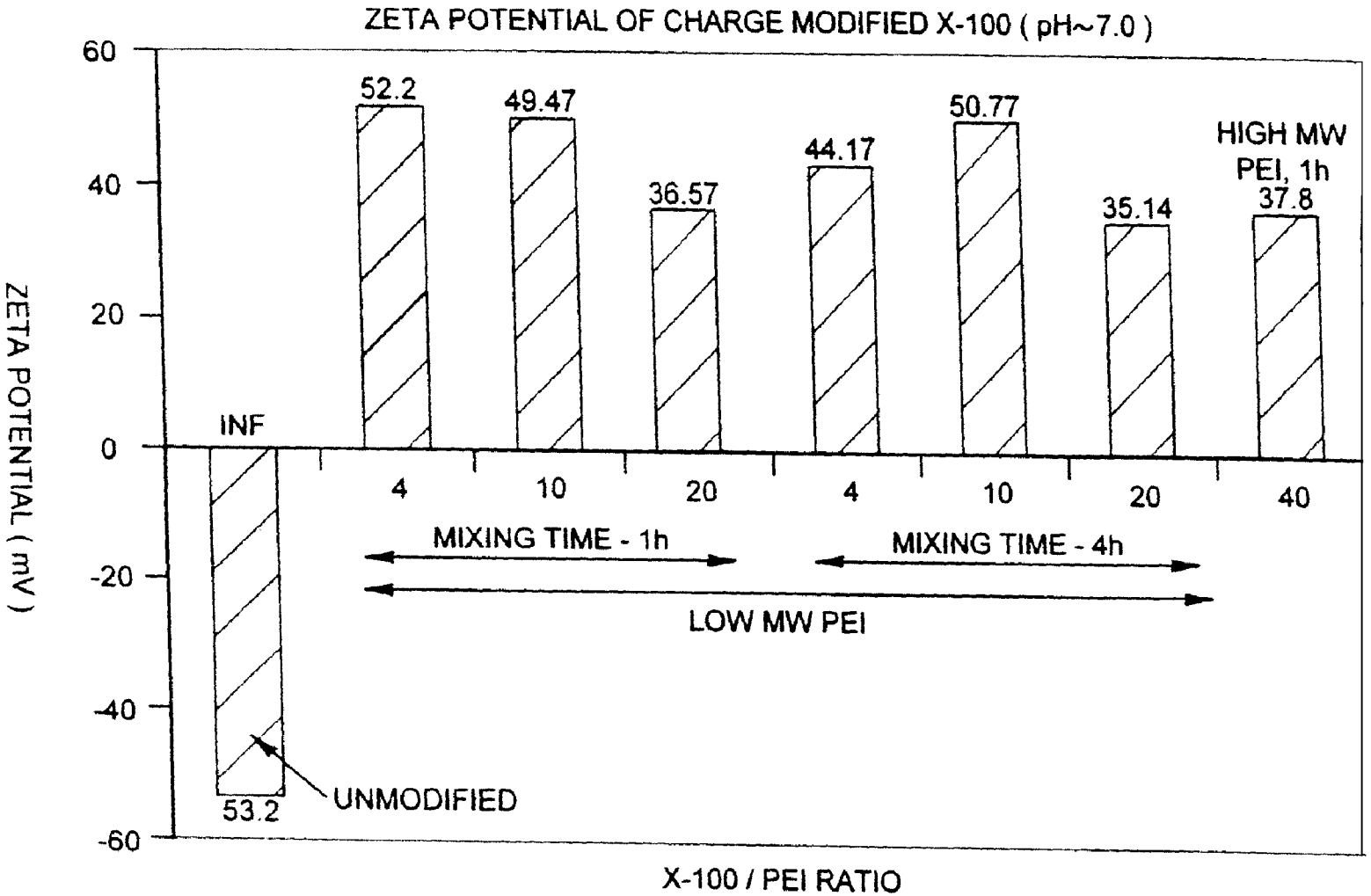
FIG. 3: Plot of zeta potential of particle formed from low and high molecular weight ionic compound (e.g. PEI) bound to expandable microsphere (i.e. X-100) at different mixing times and at different ionic compound to expandable microsphere weight ratios.
Figure 4:
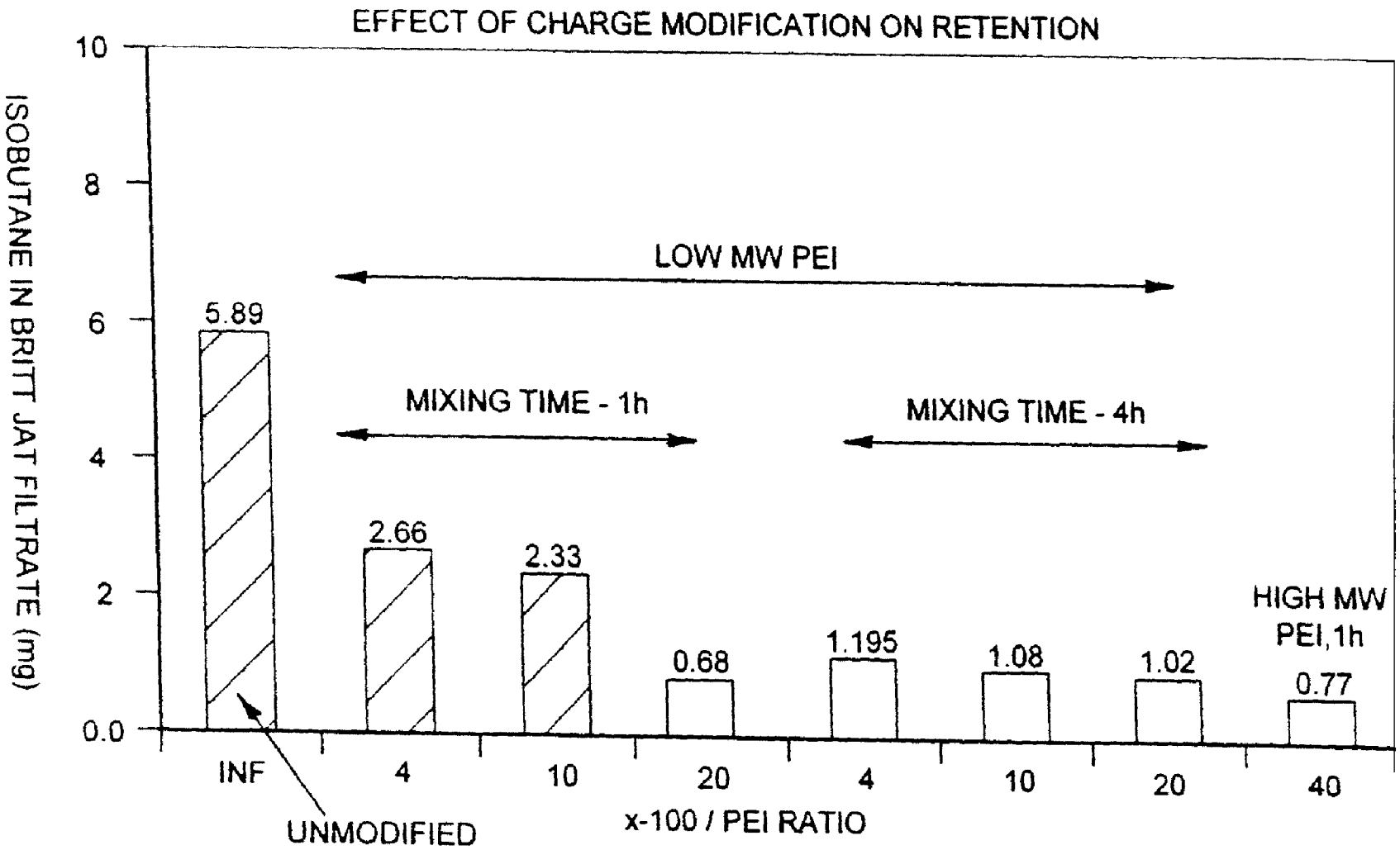
FIG. 4: Plot of results of Britt Jar analyses and blowing agent (i.e. isobutane) measurements as a function of ionic compound (low and high molecular weight ionic compound (e.g. PEI)) to expandable microsphere weight ratio and mixing time.
Figure 5:
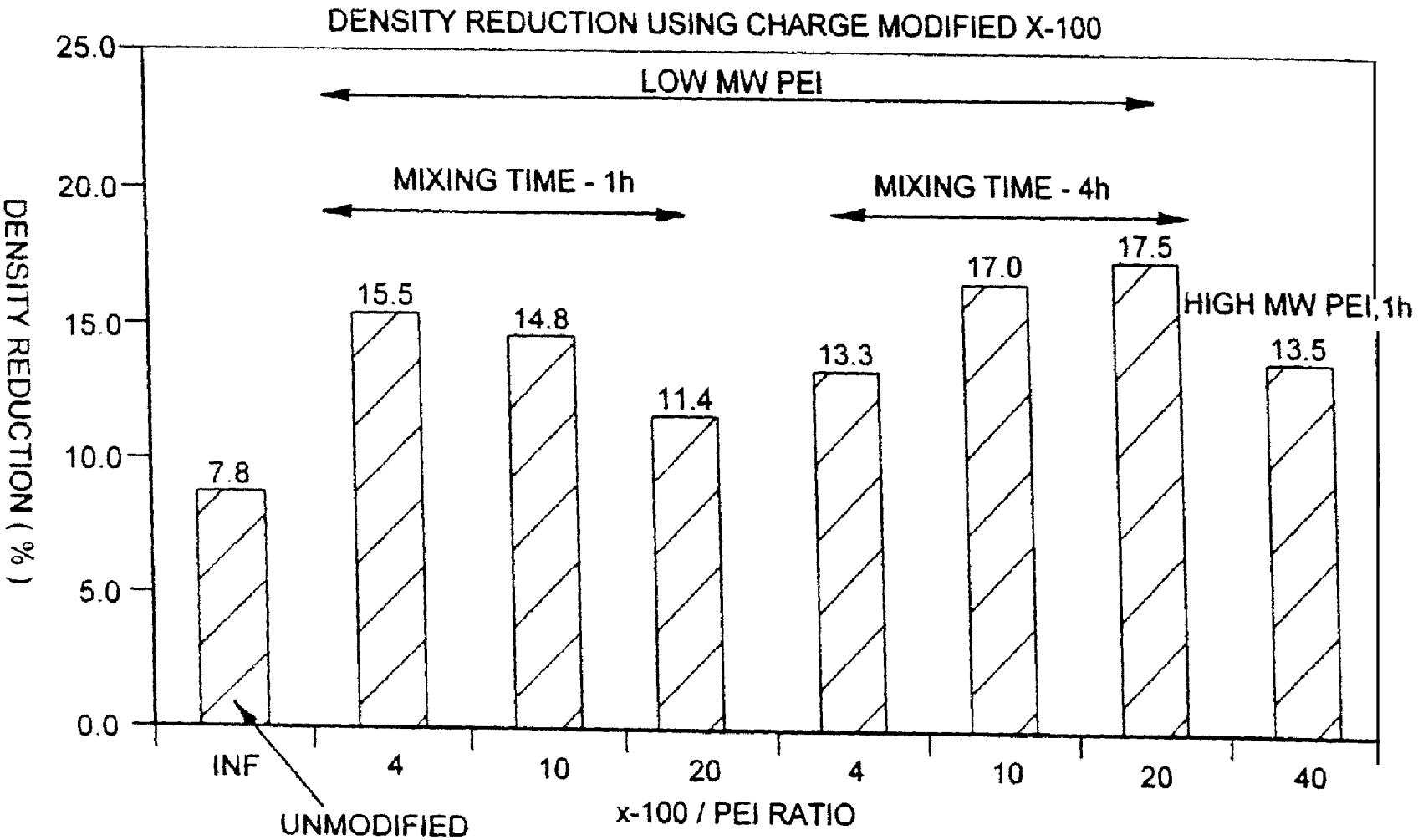
FIG. 5: Plot of Density Reduction of paper substrates containing the composition and/or particle of the present invention as a function of ionic compound (low and high molecular weight ionic compound (e.g. PEI)) to expandable microsphere weight ratio and mixing time.

The present inventors have now discovered a less costly and more efficient solution to reduce density, increase bulk, and retain the good performance characteristics such as smoothness and print mottle within a paper substrate.

The present invention may be implemented into any conventional method of making paper or paperboard substrates.

Examples of such can be found in textbooks such as those described in the "Handbook for pulp and paper technologists" by G. A. Smook (1992), Angus Wilde Publications, which is hereby incorporated, in its entirety, by reference.

One embodiment of the present invention is therefore a paper or paperboard substrate containing expandable microspheres.

The amount of the expandable microsphere can vary and will depend upon the total weight of the substrate, or the final paper or paperboard product. The paper substrate may contain greater than 0.001 wt %, more preferably greater than 0.02 wt %, most preferably greater than 0.1 wt % of expandable microspheres based on the total weight of the substrate. Further, the paper substrate may contain less than 20 wt %, more preferably less than 10 wt %, most preferably less than 5 wt % of expandable microspheres based on the total weight of the substrate. The amount of expandable microspheres may be 0.001, 0.002, 0.005, 0.01, 0.02, 0.05, 0.1, 0.2, 0.5, 1.0, 1.5, 2.0, 2.5, 3.0, 3.5, 4.0, 4.5, 5.0, 6.0, 7.0, 8.0, 9.0, 10.0, 11.0, 12.0, 13.0, 14.0, 15.0, 16.0, 17.0, 18.0, 19.0, and 20.0 wt % based on the total weight of the substrate, and including any and all ranges and subranges therein.

The expandable microspheres may contain an expandable shell forming a void inside thereof. The expandable shell may comprise a carbon and/or heteroatom containing compound. An example of a carbon and/or heteroatom-containing compound may be an organic polymer and/or copolymer. The polymer and/or copolymer may be branched and/or crosslinked.

Expandable microspheres preferably are heat expandable thermoplastic polymeric hollow spheres containing a thermally activatable expanding agent. Examples of expandable microsphere compositions, their contents, methods of manufacture, and uses can be found, in U.S. Pat. Nos. 3,615,972; 3,864,181; 4,006,273; 4,044,176; and 6,617,364 which are hereby incorporated, in their entirety, herein by reference. Further reference can be made to published U.S. Patent Applications: 20010044477; 20030008931; 20030008932; and 20040157057, which are hereby incorporated, in their entirety, herein by reference. Such expandable microspheres, for example, may be prepared from polyvinylidene chloride, polyacrylonitrile, poly-alkyl methacrylates, polystyrene or vinyl chloride.

While the expandable microsphere of the present invention may contain any polymer and/or copolymer, the polymer preferably has a Tg, or glass transition temperature, ranging from −150 to +180° C., preferably from 50 to 150° C., most preferably from 75 to 125° C. The Tg may be −150, −140, −130, −120, −110, −100, −90. −80, −70, −60, −50, −40, −30, −20, −10, 0, 10, 20, 30, 40, 50, 60, 70, 75, 80, 85, 90, 95, 100, 105, 110, 115, 120, 125, 130, 140, 150, 160, 170, and 180° C., including any and all ranges and subranges therein.

Microspheres may also contain at least one blowing agent which, upon application of an amount of heat energy, functions to provide internal pressure on the inside wall of the microsphere in a manner that such pressure causes the sphere to expand. Blowing agents may be liquids and/or gases. Further, examples of blowing agents may be selected from low boiling point molecules and compositions thereof. Such blowing agents may be selected from the lower alkanes such as neopentane, neohexane, hexane, propane, butane, pentane, and mixtures and isomers thereof. Isobutane is the preferred blowing agent for polyvinylidene chloride microspheres. Suitable coated unexpanded and expanded microspheres are disclosed in U.S. Pat. Nos. 4,722,943 and 4,829,094, which are hereby incorporated, in their entirety, herein by reference.

The expandable microspheres of the present invention may have a mean diameter ranging from about 0.5 to 200 microns, preferably from 2 to 100 microns, most preferably from 5 to 40 microns in the unexpanded state. The mean diameter may be 0.5, 1, 2, 3, 4, 5, 10, 15, 20, 25, 30, 35, 40, 45, 50, 60, 70, 80, 90, 100, 110, 120, 130, 140, 150, 160, 170, 180, 190, and 200 microns, including any and all ranges and subranges therein.

Further, the expandable microspheres of the present invention may have a maximum expansion of from about 1 to 15 times, preferably from 1.5 to 10 times, most preferably from 2 to 5 times the mean diameters. The maximum expansion may be 1, 1.5, 2, 2.5, 3, 3.5, 4, 4.5, 5, 6, 7, 8, 9, 10, 11, 12, 13, 14, and 15, including any and all ranges and subranges therein.

The expandable microspheres may be negatively or positively charged. Further, the expandable microspheres may be neutral. Still further, the expandable microspheres may be incorporated into a composition and/or particle of the present invention that has a net zeta potential that is greater than or equal to zero mV at a pH of about 9.0 or less at an ionic strength of from $10^{-6}$ M to 0.1M.

One embodiment of the present invention is a composition or particle containing an expandable microsphere.

In the composition and/or particle of the present invention, the expandable microspheres may be neutral, negatively or positively charged, preferably negatively charged.

Further, the composition and/or particle of the present invention may contain expandable microspheres of the same physical characteristics disclosed above and below and may be incorporated into the paper substrate according to the present invention in the same manner and the same amounts as mentioned above and below for the expandable microspheres.

Another embodiment of the present invention is a composition and/or particle containing at least one expandable microsphere and at least one ionic compound. The expandable microsphere may be positive, neutral and/or negatively charged. Further, the ionic compound may be positive and/or negatively charged. Preferably, the ionic compound has a net charge that is opposite than the net charge of the expandable microsphere. For example, if the net charge of the expandable microsphere is negative, then the net charge of the ionic compound may be any net charge, but preferably has a net positive charge.

In a preferred embodiment, when the composition and/or particle of the present invention contains expandable microspheres and at least one ionic compound, the composition and/or particle of the present invention has a net zeta potential that is greater than or equal to zero mV at a pH of about 9.0 or less at an ionic strength of from $10^{-6}$ M to 0.1M. Preferably, the net zeta potential is from greater than or equal to zero to +500, preferably greater than or equal to zero to +200, more preferably from greater than or equal to zero to +150, most preferably from +20 to +130, mV at a pH of about 9.0 or less at an ionic strength of from $10^{-6}$ M to 0.1M as measured by standard and conventional methods of measuring zeta potential known in the analytical and physical arts, preferably methods utilizing microelectrophoresis at room temperature.

The composition and/or particle of the present invention has a net zeta potential that is 0, 10, 15, 20, 25, 30, 35, 40, 45, 50, 55, 60, 65, 70, 75, 80, 85, 90, 95, 100, 105, 110, 115, 120, 125, 130, 140, 150, 160, 170, 180, 190, 200, 225, 250, 300, 350, 400, 450, and 500 mV, including any and all ranges and subranges therein.

When measuring the net zeta potential of the and/or particle of the present invention, preferably, such potentials are measured by standard and conventional methods of measuring zeta potential known in the analytical and physical arts, preferably methods utilizing microelectrophoresis at room temperature, when the pH is any pH, preferably about 9.0 or less, more preferably about 8.0 or less, most preferably about 7.0 or less, at an ionic strength of from $10^{-6}$ M to 0.1M. The pH may be at or about 9.0, 8.5, 8.0, 7.5, 7.0, 6.5, 6.0, 5.5, 5.0, 4.5, 4.0, 3.5, 3.0, 2.5, 2.0, 1.5, 1.0, and 0.5, including any and all ranges and subranges therein.

When measuring the net zeta potential of the composition and/or particle of the present invention, preferably, such potentials are measured by standard and conventional methods of measuring zeta potential known in the analytical and physical arts, preferably methods utilizing microelectrophoresis at room temperature, when the pH is about 9.0 or less, preferably about 8.0 or less, most preferably about 7.0 or less, at any ionic strength, preferably from $10^{-6}$ M to $10^{-1}$ M. The ionic strength may be $10^{-6}$, $10^{-5}$, $10^{-4}$, $10^{-3}$, $10^{-2}$, and $10^{-1}$ M, including any and all ranges and subranges therein.

The ionic compound may be anionic and/or cationic, preferably cationic when the expandable microspheres are anionic. Further, the ionic compound may be organic, inorganic, and/or mixtures of both. Still further, the ionic compound may be in the form of a slurry and/or colloid. Finally, the ionic compound may have a particle size ranging 1 nm to 1 micron, preferably from 2 nm to 400 mm. The ionic compound may have a particle size that is 1, 2, 3, 4, 5, 6, 7, 8, 9, 10, 12, 15, 20, 25, 30, 35, 40, 45, 50, 60, 70, 80, 90, 100, 110, 120, 130, 140, 150, 175, 200, 225, 250, 275, 300, 325, 350, 375, 400, 450, 500, 600, 700, 800, 900, and 1000 nm, where 1000 nm equals 1 micron, including any and all ranges and subranges therein.

The ionic compound may be any of the optional substances and conventional additives mentioned below and/or commonly known in the art of papermaking. More preferably, the ionic compound may be any one or combination of the retention aids mentioned below.

The weight ratio of ionic compound to expandable microsphere in the composition and/or particle of the present invention may be from 1:500 to 500:1, preferably from 1:50 to 50:1, more preferably from 1:10 to 10:1, so long as the composition and/or particle has a net zeta potential that is greater than or equal to zero mV at a pH of about 9.0 or less at an ionic strength of from $10^{-6}$ M to 0.1M. The ionic compound/expandable microsphere weight ratio may be 1:500, 1:400, 1:300, 1:200, 1:100, 1:50, 1:40, 1:30, 1:20, 1:10, 1:5, 1:1, 5:1, 10:1, 20:1, 30:1, 40:1, 50:1, 100:1, 200:1, 300:1, 400:1, and 500:1, including any and all ranges and subranges therein.

The ionic compound may be inorganic. Examples of the inorganic ionic compound may contain, but are not limited to silica, alumina, tin oxide, zirconia, antimony oxide, iron oxide, and rare earth metal oxides. The inorganic may preferably be in the form of a slurry and/or colloid and/or sol when contacted with the expandable microsphere and have a particle size ranging from 1 nm to 1 micron, preferably from 2 nm to 400 micron. When the inorganic ionic compound is in the form of a colloid and/or sol, the preferred ionic compound contains silica and/or alumina.

The ionic compound may be organic. Examples of the ionic organic compound may be carbon-containing compounds. Further, the ionic organic compound may contain heteroatoms such as nitrogen, oxygen, and/or halogen. Still further, the ionic organic compound may contain a heteroatom-containing functional group such as hydroxy, amine, amide, carbony, carboxy, etc groups. Further the ionic organic compound may contain more that one positive charge, negative charge, or mixtures thereof. The ionic organic compound may be polymeric and/or copolymeric, which may further by cyclic, branched and/or crosslinked. When the ionic organic compound is polymeric and/or copolymeric, the compound preferably has a weight average molecular weight of from 600 to 5,000,000, more preferably from 1000 to 2,000,000, most preferably from 20,000 to 800,000, weight average molecular weight. The weight average molecular weight of the ionic compound may be 600; 700; 800; 900; 1000; 2000; 3000; 4000; 5000; 7500; 10,000; 15,000; 20,000; 25,000; 30,000; 40,000; 50,000; 60,000; 70,000; 80,000; 90,000; 100,000; 200,000; 300,000, 400,000; 500,000; 600,000; 700,000; 800,000; 900,000; 1,000,000; 1,250,000; 1,500,000; 1,750,000; 2,000,000; 3,000,000; 4,000,000; and 5,000,000; including any and all ranges and subranges therein.

Preferably, the ionic organic compound may be an amine containing compound. More preferably, the ionic organic compound may be a polyamine. Examples include, but are not limited to, a poly(DADMAC), poly(vinylamine), and/or a poly(ethylene imine).

The composition and/or particle of the present invention may contain at least one expandable microsphere and at least one ionic compound. The expandable microsphere and the ionic compound may be in contact with each other. For example, the ionic compound is in contact with the outer and/or inner surface of the expandable microsphere. Preferably, the ionic compound is in contact with the outer surface of the expandable microsphere. Such contact may include, but is not limited to, situations where the expandable microsphere is coated and/or impregnated with the ionic compound. While not wishing to be bound by theory, the ionic compound is bonded to the outside surface of the expandable microsphere by covalent and/or non-covalent forces, preferably non-covalent forces, to form a particle having an inner expandable microsphere and outer ionic compound layered thereon. However, portions of the outer surface of the expandable microsphere layer may not be completely covered by the outer ionic compound layer, while other portions of the outer surface of the expandable microsphere layer may actually be completely covered by the outer ionic compound layer. This may lead to some portions of the outer surface of the expandable microsphere layer being exposed. Further, the outside surface of the expandable microsphere may be completely covered by a layer containing at least one ionic compound.

The composition and/or particle of the present invention may be made by contacting, mixing, absorbing, adsorbing, etc, the expandable microsphere with the ionic compound. The relative amounts of expandable microsphere and ionic compound may be tailored by traditional means. Preferably, the relative amounts of expandable microsphere and ionic compound may be tailored in a manner so that the resultant composition and/or particle of the present invention has a net zeta potential that is greater than or equal to zero mV at a pH of about 9.0 or less at an ionic strength of from $10^{-6}$ M to 0.1M. Preferably, the weight ratio of ionic compound contacted with the expandable microsphere in the composition and/or particle of the present invention may be from 1:100 to 100:1, preferably from 1:80 to 80:1, more preferably from 1:1 to 1:60, most preferably from 1:2 to 1:50, so long as the composition and/or particle has a net zeta potential that is greater than or equal to zero mV at a pH of about 9.0 or less at an ionic strength of from $10^{-6}$ M to 0.1M, The weight ratio of ionic compound contacted with the expandable microsphere in the composition and/or particle of the present invention may be 1:100, 1:90, 1:80, 1:70, 1:60, 1:50, 1:40, 1:30, 1:20, 1:10, 1:1, 10:1, 20:1, 30:1, 40:1, 50:1, 60:1, 70:1, 80:1, 90:1, and 100:1, including any and all ranges and subranges therein.

The amount of contact time between the ionic compound and the expandable microsphere can vary from milliseconds to years just as long as the resultant composition and/or particle has a net zeta potential that is greater than or equal to zero mV at a pH of about 9.0 or less at an ionic strength of from $10^{-6}$ M to 0.1M. Preferably, the contacting occurs from 0.01 second to 1 year, preferably from 0.1 second to 6 months, more preferably from 0.2 seconds to 3 weeks, most preferably from 0.5 seconds to 1 week.

Prior to contacting the expandable microsphere with the ionic compound, each of the expandable microsphere and/or the ionic compound may be dry and/or in a slurry, wet cake, solid, liquid, dispersion, colloid, gel, respectively. Further, each of the expandable microsphere and/or the ionic compound may be diluted and/or in concentrate.

The composition and/or particle of the present invention may have a mean diameter ranging from about 0.5 to 200 microns, preferably from 2 to 100 microns, most preferably from 5 to 40 microns in the unexpanded state. The mean diameter of the composition and/or particle may be 0.5, 1, 2, 3, 4, 5, 10, 15, 20, 25, 30, 35, 40, 45, 50, 60, 70, 80, 90, 100, 110, 120, 130, 140, 150, 160, 170, 180, 190, and 200 microns, including any and all ranges and subranges therein.

Further, the composition and/or particle of the present invention may have a maximum expansion of from about 1 to 15 times, preferably from 1.5 to 10 times, most preferably from 2 to 5 times the mean diameters. The maximum expansion may be 1, 1.5, 2, 2.5, 3, 3.5, 4, 4.5, 5, 6, 7, 8, 9, 10, 11, 12, 13, 14, and 15, including any and all ranges and subranges therein.

The composition and/or particle of the present invention may be made through the above-mentioned contacting means prior to and/or during the papermaking process. Preferably, the expandable microsphere and the ionic compound are contacted so as to produce the composition and/or particle of the present invention and then the resultant composition and/or particle of the present invention is subsequently and/or simultaneously contacted with the fibers mentioned below.

When the paper substrate of the present invention contains the composition and/or particle of the present invention, the amount of the composition and/or particle of the present invention can vary and will depend upon the total weight of the substrate, or the final paper or paperboard product. The paper substrate may contain greater than 0.001 wt %, more preferably greater than 0.02 wt %, most preferably greater than 0.1 wt % of the composition and/or particle of the present invention based on the total weight of the substrate. Further, the paper substrate may contain less than 20 wt %, more preferably less than 10 wt %, most preferably less than 5 wt % of the composition and/or particle of the present invention based on the total weight of the substrate. The amount of the composition and/or particle of the present invention may be 0.001, 0.002, 0.005, 0.01, 0.02, 0.05, 0.1, 0.2, 0.5, 1.0, 1.5, 2.0, 2.5, 3.0, 3.5, 4.0, 4.5, 5.0, 6.0, 7.0, 8.0, 9.0, 10.0, 11.0, 12.0, 13.0, 14.0, 15.0, 16.0, 17.0, 18.0, 19.0, and 20.0 wt % based on the total weight of the substrate, and including any and all ranges and subranges therein.

The paper substrate contains a web of cellulose fibers. The paper substrate of the present invention may contain recycled fibers and/or virgin fibers. Recycled fibers differ from virgin fibers in that the fibers have gone through the drying process at least once. In certain embodiments, at least a portion of the cellulose/pulp fibers may be provided from non-woody herbaceous plants including, but not limited to, kenaf, hemp, jute, flax, sisal, or abaca although legal restrictions and other considerations may make the utilization of hemp and other fiber sources impractical or impossible. Either bleached or unbleached pulp fiber may be utilized in the process of this invention.

The paper substrate of the present invention may contain from 1 to 99 wt %, preferably from 5 to 95 wt % of cellulose fibers based upon the total weight of the substrate, including 1, 5, 10, 15, 20, 25, 30, 35, 40, 45, 50, 55, 60, 65, 70, 75, 80, 85, 90, 95 and 99 wt %, and including any and all ranges and subranges therein.

Preferably, the sources of the cellulose fibers are from softwood and/or hardwood.

The paper substrate of the present invention may contain from 1 to 100 wt %, preferably from 10 to 60 wt %, cellulose fibers originating from softwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate may alternatively or overlappingly contain from 0.01 to 100 wt % fibers from softwood species most preferably from 10 to 60 wt % based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % softwood based upon the total weight of the paper substrate, including any and all ranges and subranges therein.

The paper substrate may contain softwood fibers from softwood species that have a Canadian Standard Freeness (csf) of from 300 to 750, more preferably from 450 to 750. This range includes 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 csf, including any and all ranges and subranges therein. Canadian Standard Freeness is as measured by TAPPI T-227 standard test.

The paper substrate of the present invention may contain from 1 to 99 wt %, preferably from 30 to 90 wt %, cellulose fibers originating from hardwood species based upon the total amount of cellulose fibers in the paper substrate. This range includes 1, 2, 5, 10, 15, 20, 25, 30, 35, 40, 45, 50, 55, 60, 65, 70, 75, 80, 85, 90, 95, and 100 wt %, including any and all ranges and subranges therein, based upon the total amount of cellulose fibers in the paper substrate.

The paper substrate may alternatively or overlappingly contain from 0.01 to 100 wt % fibers from hardwood species, preferably from 60 to 90 wt % based upon the total weight of the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95, 99 and 100 wt % fines based upon the total weight of the paper substrate, including any and all ranges and subranges therein.

The paper substrate may contain fibers from hardwood species that have a Canadian Standard Freeness (csf) of from 300 to 750, more preferably from 450 to 750 csf. This range includes 300, 310, 320, 330, 340, 350, 360, 370, 380, 390, 400, 410, 420, 430, 440, 450, 460, 470, 480, 490, 500, 510, 520, 530, 540, 550, 560, 570, 580, 590, 600, 610, 620, 630, 640, 650, 660, 670, 680, 690, 700, 710, 720, 730, 740, and 750 csf, including any and all ranges and subranges therein. Canadian Standard Freeness is as measured by TAPPI T-227 standard test.

When the paper substrate contains both hardwood and softwood fibers, it is preferable that the hardwood/softwood ratio be from 0.001 to 1000, preferably from 90/10 to 30/60.

This range may include 0.001, 0.002, 0.005, 0.01, 0.02, 0.05, 0.1, 0.2, 0.5, 1, 2, 5, 10, 15, 20, 25, 30, 35, 40, 45, 50, 55, 60, 65, 70, 75, 80, 85, 90, 95, 100, 200, 300, 400, 500, 600, 700, 800, 900, and 1000 including any and all ranges and subranges therein and well as any ranges and subranges therein the inverse of such ratios.

Further, the softwood and/or hardwood fibers contained by the paper substrate of the present invention may be modified by physical and/or chemical means. Examples of physical means include, but is not limited to, electromagnetic and mechanical means. Means for electrical modification include, but are not limited to, means involving contacting the fibers with an electromagnetic energy source such as light and/or electrical current. Means for mechanical modification include, but are not limited to, means involving contacting an inanimate object with the fibers. Examples of such inanimate objects include those with sharp and/or dull edges. Such means also involve, for example, cutting, kneading, pounding, impaling, etc means.

Examples of chemical means include, but is not limited to, conventional chemical fiber modification means including crosslinking and precipitation of complexes thereon. Examples of such modification of fibers may be, but is not limited to, those found in the following U.S. Pat. Nos. 6,592,717, 6,592,712, 6,582,557, 6,579,415, 6,579,414, 6,506,282, 6,471,824, 6,361,651, 6,146,494, H1,704, 5,731,080, 5,698,688, 5,698,074, 5,667,637, 5,662,773, 5,531,728, 5,443,899, 5,360,420, 5,266,250, 5,209,953, 5,160,789, 5,049,235, 4,986,882, 4,496,427, 4,431,481, 4,174,417, 4,166,894, 4,075,136, and 4,022,965, which are hereby incorporated, in their entirety, herein by reference. Further modification of fibers is found in U.S. Patent Application No. 60/654,712 filed Feb. 19, 2005, which may include the addition of optical brighteners (i.e. OBAs) as discussed therein, which is hereby incorporated, in its entirety, herein by reference.

Sources of "Fines" may be found in SaveAll fibers, recirculated streams, reject streams, waste fiber streams. The amount of "fines" present in the paper substrate can be modified by tailoring the rate at which such streams are added to the paper making process.

The paper substate preferably contains a combination of hardwood fibers, softwood fibers and "fines" fibers. "Fines" fibers are, as discussed above, recirculated and are typically not more that 100 μm in length on average, preferably not more than 90 μm, more preferably not more than 80 μm in length, and most preferably not more than 75 μm in length. The length of the fines are preferably not more than 5, 10, 15, 20, 25, 30, 35, 40, 45, 50, 55, 60, 65, 70, 75, 80, 85, 90, 95, and 100 μm in length, including any and all ranges and subranges therein.

The paper substrate contains from 0.01 to 100 wt % fines, preferably from 0.01 to 50 wt %, most preferably from 0.01 to 15 wt % based upon the total weight of the substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the paper, including any and all ranges and subranges therein.

The paper substrate may alternatively or overlappingly contain from 0.01 to 100 wt % fines, preferably from 0.01 to 50 wt %, most preferably from 0.01 to 15 wt % based upon the total weight of the fibers contained by the paper substrate. The paper substrate contains not more than 0.01, 0.05, 0.1, 0.2, 0.5, 1, 2, 3, 4, 5, 6, 7, 8, 9, 10, 12, 15, 20, 25, 30, 35, 40, 45, 50, 55, 60, 65, 70, 75, 80, 85, 90, 95 and 100 wt % fines based upon the total weight of the fibers contained by the paper substrate, including any and all ranges and subranges therein.

In a preferred embodiment, any of the above-mentioned fibers may be treated so as to have a high ISO brightness. Examples of such fibers treated in this manner include, but is not limited to, those described in U.S. patent application Ser. No. 11/358,543, filed Feb. 21, 2006, and entitled "PULP AND PAPER HAVING INCREASED BRIGHTNESS", which is hereby incorporated, in its entirety, herein by reference; and PCT Patent Application Number PCT/US06/06011, filed Feb. 21, 2006, and entitled "PULP AND PAPER HAVING INCREASED BRIGHTNESS", which is hereby incorporated, in its entirety, herein by reference.

While the pulp, fibers, and/or paper substrate may have any brightness and/or CIE whiteness, preferably within this embodiment, such brightness and/or CIE whiteness is as follows.

Preferably, the fiber and/or the pulp and/or paper substrate of the present invention may have any CIE whiteness, but preferably has a CIE whiteness of greater than 70, more preferably greater than 100, most preferably greater than 125 or even greater than 150. The CIE whiteness may be in the range of from 125 to 200, preferably from 130 to 200, most preferably from 150 to 200. The CIE whiteness range may be greater than or equal to 70, 80, 90, 100, 110, 120, 125, 130, 135, 140, 145, 150, 155, 160, 65, 170, 175, 180, 185, 190, 195, and 200 CIE whiteness points, including any and all ranges and subranges therein. Examples of measuring CIE whiteness and obtaining such whiteness in a fiber and paper made therefrom can be found, for example, in U.S. Pat. No. 6,893,473, which is hereby incorporated, in its entirety, herein by reference.

The fibers, the pulp and/or paper substrate of the present invention may have any ISO brightness, but preferably greater than 80, more preferably greater than 90, most preferably greater than 95 ISO brightness points. The ISO brightness may be preferably from 80 to 100, more preferably from 90 to 100, most preferably from 95 to 100 ISO brightness points. This range include greater than or equal to 80, 85, 90, 91, 92, 93, 94, 95, 96, 97, 98, 99, and 100 ISO brightness points, including any and all ranges and subranges therein. Examples of measuring ISO brightness and obtaining such brightness in a papermaking fiber and paper made therefrom can be found, for example, in U.S. Pat. No. 6,893,473, which is hereby incorporated, in its entirety, herein by reference.

The paper substrate of the present invention may have a pH of from 1.0 to 14.0, preferably 4.0 to 9.0, as measured by any conventional method such as a pH marker/pen and conventional TAPPI methods 252 and 529 (hot extraction test and/or surface pH test). This range includes pH's of 4.0, 4.5, 5.0, 5.5, 6.0, 6.5, 7.0, 7.5, 8.0, 8.5, and 9.0 including any and all ranges and subranges therein.

The paper substrate according to the present invention may be made off of the paper machine having any basis weight. The paper substrate may have either a high or low basis weight, including basis weights of at least 10 lbs/3000 square foot, preferably from at least 20 to 500 lbs/3000 square foot, more preferably from at least 40 to 325 lbs/3000 square foot. The basis weight may be 10, 20, 30, 40, 50, 60, 70, 80, 90, 100, 110, 120, 130, 140, 150, 160, 170, 180, 190, 200, 210, 220, 230, 240, 250, 260, 270, 280, 290, 300, 310, 320, 330, 340, 350, 360, 370, 380, 390, 400, 425, 450, 475, and 500 lbs/3000 square foot, including any and all ranges and subranges therein. Of course these weights can easily be converted so as to be based upon 1300 square foot.

The paper substrate according to the present invention may have an apparent density of from 1 to 20, preferably 4 to 14, most preferably from 5 to 10, lb/3000 sq. ft. per 0.001 inch thickness. The paper substrate may have an apparent density of 1, 2, 3, 4, 5, 6, 7, 8, 9, 10, 11, 12, 13, 14, 15, 16, 17, 18, 19, and 20 lb/3000 sq. ft. per 0.001 inch thickness, including any and all ranges and subranges therein. Of course, these weights can easily be converted so as to be based upon 1300 square foot.

The paper substrate according to the present invention may have a caliper of from 2 to 35 mil, preferably from 5 to 30 mil, more preferably from 10 to 28 mil, most preferably from 12 to 24 mil. The paper substrate may have a caliper that is 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, and 35 mil, including any and all ranges and subranges therein. Any of the above-mentioned calipers of the present invention may be that of the paper substrate of the present invention either prior to or after calendaring means, such as those mentioned later below.

The paper substrate according to the present invention may have a Sheffield Smoothness of less than 400 Sheffield Units (SU). However, the preferred Sheffield Smoothness will be driven by the end product paper substrate's intended use. Preferably, the paper substrate according to the present invention may have a Sheffield Smoothness of less than 350 SU, more preferably less than 250 SU, most preferably less than 200 SU, as measured by TAPPI test method T 538 om-1, including any and all ranges and subranges therein. The paper substrate may have a Sheffield Smoothness that is 400, 350, 300, 275, 250, 225, 200, 190, 180, 170, 160, 150, 140, 130, 120, 110, 100, 90, 80, 70, 60, 50, 40, 30, 20, and 10, including any and all ranges and subranges therein.

The Sheffield Smoothness of the paper substrate of the present invention is improved by at least 1%, preferably at least 20%, more preferably by at least 30%, and most preferably by at least 50% compared to that of conventional paper substrates not containing the expandable microspheres and/or the composition and/or particle of the present invention. The Sheffield Smoothness of the paper substrate of the present invention is improved by 1, 5, 10, 20, 30, 40, 50, 60, 70, 80, 90, 100, 125, 150, 175, 200, 250, 300, 350, 400, 450, 500, 600, 700, 800, 900, and 1000% compared to that of conventional paper substrates not containing the expandable microspheres and/or the composition and/or particle of the present invention.

The paper substrate of the present invention may also include optional substances including retention aids, sizing agents, binders, fillers, thickeners, and preservatives. Examples of fillers include, but are not limited to; clay, calcium carbonate, calcium sulfate hemihydrate, and calcium sulfate dehydrate. A preferable filler is calcium carbonate with the preferred form being precipitated calcium carbonate. Examples of binders include, but are not limited to, polyvinyl alcohol, Amres (a Kymene type), Bayer Parez, polychloride emulsion, modified starch such as hydroxyethyl starch, starch, polyacrylamide, modified polyacrylamide, polyol, polyol carbonyl adduct, ethanedial/polyol condensate, polyamide, epichlorohydrin, glyoxal, glyoxal urea, ethanedial, aliphatic polyisocyanate, isocyanate, 1,6 hexamethylene diisocyanate, diisocyanate, polyisocyanate, polyester, polyester resin, polyacrylate, polyacrylate resin, acrylate, and methacrylate. Other optional substances include, but are not limited to silicas such as colloids and/or sols. Examples of silicas include, but are not limited to, sodium silicate and/or borosilicates. Other examples of optional substances are solvents including but not limited to water.

The paper substrate of the present invention may contain retention aids selected from the group consisting of coagulation agents, flocculation agents, and entrapment agents dispersed within the bulk and porosity enhancing additives cellulosic fibers.

Retention aids for the bulk-enhancing additives to retain a significant percentage of the additive in the middle of the paperboard and not in the periphery. Suitable retention aids function through coagulation, flocculation, or entrapment of the bulk additive. Coagulation comprises a precipitation of initially dispersed colloidal particles. This precipitation is suitably accomplished by charge neutralization or formation of high charge density patches on the particle surfaces. Since natural particles such as fines, fibers, clays, etc., are anionic, coagulation is advantageously accomplished by adding cationic materials to the overall system. Such selected cationic materials suitably have a high charge to mass ratio. Suitable coagulants include inorganic salts such as alum or aluminum chloride and their polymerization products (e.g. PAC or poly aluminum chloride or synthetic polymers); poly(diallyldimethyl ammonium chloride) (i.e., DADMAC); poly (dimethylamine)-co-epichlorohydrin; polyethylenimine; poly(3-butenyltrimethyl ammoniumchloride); poly(4-ethenylbenzyltrimethylammonium chloride); poly(2,3-epoxypropyltrimethylammonium chloride); poly(5-isoprenyltrimethylammonium chloride); and poly (acryloyloxyethyltrimethylammonium chloride). Other suitable cationic compounds having a high charge to mass ratio include all polysulfonium compounds, such as, for example the polymer made from the adduct of 2-chloromethyl; 1,3-butadiene and a dialkylsulfide, all polyamines made by the reaction of amines such as, for example, ethylenediamine, diethylenetriamine, triethylenetetraamine or various dialkylamines, with bis-halo, bis-epoxy, or chlorohydrin compounds such as, for example, 1-2 dichloroethane, 1,5-diepoxyhexane, or epichlorohydrin, all polymers of guanidine such as, for example, the product of guanidine and formaldehyde with or without polyamines. The preferred coagulant is poly(diallyldimethyl ammonium chloride) (i.e., DADMAC) having a molecular weight of about ninety thousand to two hundred thousand and polyethylenimine having a molecular weight of about six hundred to 5 million. The molecular weights of all polymers and copolymers herein this application are based on a weight average molecular weight commonly used to measure molecular weights of polymeric systems.

Another advantageous retention system suitable for the manufacture of paperboard of this invention is flocculation. This is basically the bridging or networking of particles through oppositely charged high molecular weight macromolecules. Alternatively, the bridging is accomplished by employing dual polymer systems. Macromolecules useful for the single additive approach are cationic starches (both amylase and amylopectin), cationic polyacrylamide such as for example, poly(acrylamide)-co-diallyldimethyl ammonium chloride; poly(acrylamide)-co-acryloyloxyethyl trimethylammonium chloride, cationic gums, chitosan, and cationic polyacrylates. Natural macromolecules such as, for example, starches and gums, are rendered cationic usually by treating them with 2,3-epoxypropyltrimethylammonium chloride, but other compounds can be used such as, for example, 2-chloroethyl-dialkylamine, acryloyloxyethyldialkyl ammonium chloride, acrylamidoethyltrialkylammonium chloride, etc. Dual additives useful for the dual polymer approach are any of those compounds which function as coagulants plus a high molecular weight anionic macromolecule such as, for example, anionic starches, CMC (carboxymethylcellulose), anionic gums, anionic polyacrylamides (e.g., polyacrylamide)-co-acrylic acid), or a finely dispersed colloidal particle (e.g., colloidal silica, colloidal alumina, bentonite clay, or polymer micro particles marketed by Cytec Industries as Polyflex). Natural macromolecules such as, for example, cellulose, starch and gums are typically rendered anionic by treating them with chloroacetic acid, but other methods such as phosphorylation can be employed. Suitable flocculation agents are nitrogen containing organic polymers having a molecular weight of about one hundred thousand to thirty million. The preferred polymers have a molecular weight of about ten to twenty million. The most preferred have a molecular weight of about twelve to eighteen million. Suitable high molecular weight polymers are polyacrylamides, anionic acrylamide-acrylate polymers, cationic acrylamide copolymers having a molecular weight of about five hundred thousand to thirty million and polyethylenimenes having molecular weights in the range of about five hundred thousand to two million.

The third method for retaining the bulk additive in the fiberboard is entrapment. This is the mechanical entrapment of particles in the fiber network. Entrapment is suitably achieved by maximizing network formation such as by forming the networks in the presence of high molecular weight anionic polyacrylamides, or high molecular weight polyethyleneoxides (PEO). Alternatively, molecular nets are formed in the network by the reaction of dual additives such as, for example, PEO and a phenolic resin.

The optional substances may be dispersed throughout the cross section of the paper substrate or may be more concentrated within the interior of the cross section of the paper substrate. Further, other optional substances such as binders and/or sizing agents for example may be concentrated more highly towards the outer surfaces of the cross section of the paper substrate. More specifically, a majority percentage of optional substances such as binders or sizing agents may preferably be located at a distance from the outside surface of the substrate that is equal to or less than 25%, more preferably 10%, of the total thickness of the substrate. Examples of localizing such optional substances such as binders/sizing agents as a function of the cross-section of the substrate is, for example, paper substrates having an "I-beam" structure and may be found in U.S. Provisional Patent Applications 60/759,629, entitled "PAPER SUBSTRATES CONTAINING HIGH SURFACE SIZING AND LOW INTERNAL SIZING AND HAVING HIGH DIMENSIONAL STABILITY", which is hereby incorporated, in its entirety, herein by reference. Further examples that include the addition of bulking agents may be found in U.S. Provisional Patent Applications 60/759,630, entitled "PAPER SUBSTRATES CONTAINING A BULKING AGENT, HIGH SURFACE SIZING, LOW INTERNAL SIZING AND HAVING HIGH DIMENSIONAL STABILITY", which is hereby incorporated, in its entirety, herein by reference; and U.S. patent application Ser. No. 10/662,699, now published as publication number 2004-0065423, entitled "PAPER WITH IMPROVED STIFFNESS AND BULK AND METHOD FOR MAKING SAME", which is hereby incorporated, in its entirety, herein by reference.

One example of a binder is polyvinyl alcohol such as polyvinyl alcohol having a % hydrolysis ranging from 100% to 75%. The % hydrolysis of the polyvinyl alcohol may be 75, 76, 78, 80, 82, 84, 85, 86, 88, 90, 92, 94, 95, 96, 98, and 100% hydrolysis, including any and all ranges and subranges therein.

The paper substrate of the present invention may then contain PVOH at a wt % of from 0.05 wt % to 20 wt % based on the total weight of the substrate. This range includes 0.001, 0.002, 0.005, 0.006, 0.008, 0.01, 0.02, 0.03, 0.04, 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein.

The paper substrate of the present invention may also contain a surface sizing agent such as starch and/or modified and/or functional equivalents thereof at a wt % of from 0.05 wt % to 20 wt %, preferably from 5 to 15 wt % based on the total weight of the substrate. The wt % of starch contained by the substrate may be 0.05, 0.1, 0.2, 0.4, 0.5, 0.6, 0.7, 0.8, 0.9, 1, 2, 4, 5, 6, 8, 10, 12, 14, 15, 16, 18, and 20 wt % based on the total weight of the substrate, including any and all ranges and subranges therein. Examples of modified starches include, for example, oxidized, cationic, ethylated, hydroethoxylated, etc. Examples of functional equivalents are, but not limited to, polyvinyl alcohol, polyvinylamine, alginate, carboxymethyl cellulose, etc.

The paper substrate may be made by contacting the expandable microspheres and/or the composition and/or particle of the present invention with cellulose fibers consecutively and/or simultaneously. Still further, the contacting may occur at acceptable concentration levels that provide the paper substrate of the present invention to contain any of the above-mentioned amounts of cellulose and expandable microspheres and/or the composition and/or particle of the present invention isolated or in any combination thereof. More specifically, the paper substrate of the present application may be made by adding from 0.25 to 20 lbs of expandable microspheres and/or the composition and/or particle per ton of cellulose fibers. The amount of expandable microspheres and/or the composition and/or particle per ton of cellulose fibers may be 0.25, 0.5, 1, 2, 3, 4, 5, 6, 7, 8, 9, 10, 11, 12, 13, 14, 15, 16, 17, 18, 19 and 20 lbs.

The contacting may occur anytime in the papermaking process including, but not limited to the thick stock, thin stock, head box, and coater with the preferred addition point being at the thin stock. Further addition points include machine chest, stuff box, and suction of the fan pump.

The paper substrate may be made by contacting further optional substances with the cellulose fibers as well. The contacting may occur anytime in the papermaking process including, but not limited to the thick stock, thin stock, head box, size press, water box, and coater. Further addition points include machine chest, stuff box, and suction of the fan pump. The cellulose fibers, expandable microspheres, and/or optional components may be contacted serially, consecutively, and/or simultaneously in any combination with each other. The cellulose fibers and expandable microspheres may be pre-mixed in any combination before addition to or during the paper-making process.

The paper substrate may be pressed in a press section containing one or more nips. However, any pressing means commonly known in the art of papermaking may be utilized. The nips may be, but is not limited to, single felted, double felted, roll, and extended nip in the presses. However, any nip commonly known in the art of papermaking may be utilized.

The paper substrate may be dried in a drying section. Any drying means commonly known in the art of papermaking may be utilized. The drying section may include and contain a drying can, cylinder drying, Condebelt drying, IR, or other drying means and mechanisms known in the art. The paper substrate may be dried so as to contain any selected amount of water. Preferably, the substrate is dried to contain less than or equal to 10% water.

The paper substrate may be passed through a size press, where any sizing means commonly known in the art of papermaking is acceptable. The size press, for example, may be a puddle mode size press (e.g. inclined, vertical, horizontal) or metered size press (e.g. blade metered, rod metered). At the size press, sizing agents such as binders may be contacted with the substrate. Optionally these same sizing agents may be added at the wet end of the papermaking process as needed. After sizing, the paper substrate may or may not be dried again according to the above-mentioned exemplified means and other commonly known drying means in the art of papermaking. The paper substrate may be dried so as to contain any selected amount of water. Preferably, the substrate is dried to contain less than or equal to 10% water.

The paper substrate may be calendered by any commonly known calendaring means in the art of papermaking. More specifically, one could utilize, for example, wet stack calendering, dry stack calendering, steel nip calendaring, hot soft calendaring or extended nip calendering, etc. While not wishing to be bound by theory, it is thought that the presence of the expandable microspheres and/or composition and/or particle of the present invention may reduce and alleviate requirements for harsh calendaring means and environments for certain paper substrates, dependent on the intended use thereof. During calendaring, the substrate may be subjected to any nip pressure. However, preferably nip pressures may be from 5 to 50 psi, more preferably from 5 to 30 psi. The nip pressure may be 5, 10, 15, 20, 25, 30, 35, 40, 45, and 50 psi, including any and all ranges and subranges therein.

The paper substrate may be microfinished according to any microfinishing means commonly known in the art of papermaking. Microfinishing is a means involving frictional processes to finish surfaces of the paper substrate. The paper substrate may be microfinished with or without a calendering means applied thereto consecutively and/or simultaneously. Examples of microfinishing means can be found in United States Published Patent Application 20040123966 and references cited therein, which are all hereby, in their entirety, herein incorporated by reference.

In one embodiment of the present invention, the paper substrate of the present invention may be a coated paper substrate. Accordingly in this embodiment, the paper board and/or substrate of the present invention may also contain at least one coating layer, including optionally two coating layers and/or a plurality thereof. The coating layer may be applied to at least one surface of the paper board and/or substrate, including two surfaces. Further, the coating layer may penetrate the paper board and/or substrate. The coating layer may contain a binder. Further the coating layer may also optionally contain a pigment. Other optional ingredients of the coating layer are surfactants, dispersion aids, and other conventional additives for printing compositions.

The coating layer may contain a coating polymer and/or copolymer which may be branched and/or crosslinked. Polymers and copolymers suitable for this purpose are polymers having a melting point below 270° C. and a glass transition temperature (Tg) in the range of −150 to +120° C. The polymers and copolymers contain carbon and/or heteroatoms. Examples of suitable polymers may be polyolefins such as polyethylene and polypropylene, nitrocellulose, polyethylene terephthalate, Saran and styrene acrylic acid copolymers. Representative coating polymers include methyl cellulose, carboxymethyl cellulose acetate copolymer, vinyl acetate copolymer, styrene butadiene copolymer, and styrene-acrylic copolymer. Any standard paper board and/or substrate coating composition may be utilized such as those compositions and methods discussed in U.S. Pat. No. 6,379,497, which is hereby incorporated, in its entirety, herein by reference. However, examples of a preferred coating composition that may be utilized is found in U.S. patent application Ser. No. 10/945,306, filed Sep. 20, 2004, which is hereby incorporated, in its entirety, herein by reference.

The coating layer may include a plurality of layers or a single layer having any conventional thickness as needed and produced by standard methods, especially printing methods. For example, the coating layer may contain a basecoat layer and a topcoat layer. The basecoat layer may, for example, contain low density thermoplastic particles and optionally a first binder. The topcoat layer may, for example, contain at least one pigment and optionally a second binder which may or may not be a different binder than the first. The particles of the basecoat layer and the at least one pigment of the topcoat layer may be dispersed in their respective binders.

The thickness of the coating layer can vary widely and any thickness can be used. Generally, the thickness of the coating layer is from about 1.8 to about 9.0 μm at a minimum, which is figured on the average density and weight ratio of each component in a coating. The thickness of the coating layer is preferably from about 2.7 to about 8.1 μm and more preferably from about 3.2 to about 6.8 μm. The coating layer thickness may be 1.8, 2.0, 2.2, 2.5, 2.7, 3.0, 3.2, 2.5, 3.7, 4.0, 4.2, 4.5, 4.7, 5.0, 5.2, 5.5, 5.7, 6.0, 6.2, 6.5, 6.7, 7.0, 7.2, 7.5, 7.7, 8.0, 8.2, 8.5, 8.7, and 9.0 μm, including any and all ranges and subranges therein.

Coat weight of the coating layer can vary widely and any conventional coat can be used. Basecoats are generally applied to paper substrates in an amount from about 4 to about 20 gsm. The coat weight of the basecoat is preferably from about 6 to about 18 gsm and more preferably from about 7 to about 15 gsm. The basecoat coat weight is 4, 5, 6, 7, 8, 9, 10, 11, 12, 13, 14, 15, 16, 17, 18, 19, and 20 gsm, including any and all ranges and subranges therein.

While the coated or uncoated paper substrate may have any basis weight, in one embodiment, the coated paper substrate according to the present invention may have basis weights from of at least 20 lbs/3000 square foot, preferably from 140 to 325 lbs/3000 square foot. The coated paper substrate may have a basis weight of 20, 40, 60, 80, 100, 120, 140, 150, 160, 170, 180, 190, 200, 210, 220, 240, 250, 260, 270, 280, 290, 300, 310, 320, and 325, including any and all ranges and subranges therein.

While the coated or uncoated paper substrate may have any apparent density, in one embodiment, the coated paper substrate according to the present invention may have an apparent density of from 4 to 12, preferably 5 to 10, lb/3000 sq. ft. per 0.001 inch thickness. The apparent density of the coated paper substrate of this embodiment may be 4, 5, 6, 7, 8, 9, 10, 11, and 12 lb/3000 sq. ft. per 0.001 inch thickness, including any and all ranges and subranges therein.

While the coated or uncoated paper substrate may have any apparent density, in one embodiment, the coated paper substrate according to the present invention may have a caliper of from 8 to 32 mil, preferably from 12 to 24 mil. The caliper of the coated paper substrate of this embodiment may be 8, 10, 12, 13, 14, 15, 16, 17, 18, 19, 20, 21, 22, 23, 24, 26, 28, 30 and 32 mil, including any and all ranges and subranges therein.

While the coated or uncoated paper substrate may have any Sheffield Smoothness, in one embodiment, the coated paper substrate according to the present invention may have a Sheffield Smoothness that is less than 50, preferably less than 30, more preferably less than 20, and most preferably less than 15 as measured by TAPPI test method T 538 om-1. The Sheffield Smoothness of the coated paper substrate of this embodiment may be 50, 45, 40, 35, 30, 25, 20, 15, 10, and 5 SU, including any and all ranges and subranges therein. The Sheffield Smoothness may prior to or after calendaring. The Sheffield Smoothness of the coated substrate of the present invention is improved by 10%, preferably 20%, more preferably by 30%, and most preferably by 50% compared to that of conventional coated paper substrates not containing expandable microspheres, the composition, and/or the particle of the present invention.

While the coated or uncoated paper substrate may have any Parker Print Smoothness (10 kgf/cm$^2$), in one embodiment, the coated paper substrate according to the present invention may have a Parker Print Smoothness (10 kgf/cm$^2$) may be less than or equal to 2, preferably less than 1.5, more preferably less than 1.3, and most preferably from about 1.0 to 0.5 as measured by TAPPI test method T 555 om-99. The Parker Print Smoothness (10 kgf/cm$^2$) of the coated paper substrate of this invention may be 2.0, 1.8, 1.6, 1.4, 1.2, 1.0, 0.8, 0.6, 0.4 and 0.2, including any and all ranges and subranges therein. The Parker Print Smoothness of the coated substrate of the present invention is improved by 5%, preferably 20%, more preferably by 30%, and most preferably by 40% compared to that of conventional coated paper substrates not containing expandable microspheres, the composition, and/or the particle of the present invention. A preferred improvement in the Parker Print Smoothness is in the range or from 10 to 20% compared to that of conventional coated paper substrates not containing expandable microspheres, the composition, and/or the particle of the present invention.

The coated paper substrate according to the present invention may have an improved print mottle as measured by 2$^{nd}$ Cyan scanner mottle. Scanner mottle is determined using the following procedure: Representative samples are selected from pigment coated paper or paperboard printed under controlled conditions typical of commercial offset litho production with the cyan process ink at a reflection density of 1.35±0.05. A 100 percent solid cyan print reflective image is digitally scanned and transformed through a neural network model to produce a print mottle index number between zero (perfectly uniform ink lay with no mottle) to ten (visually noticeable, objectionable and likely rejectable because of print mottle, a random non-uniformity in the visual reflective density or color of the printed area). Data from this 2$^{nd}$ Cyan scanner mottle system can be correlated to subjective visual perception (using the zero-to-ten guideline) or can be transformed into equivalent mottle values as measured with a Tobias mottle tester from Tobias Associates using the following equation:

$$\text{Tobias}=\text{Scanner Mottle}*8.8+188$$

The methods of describing the procedures and details of setting up of the above-mentioned equation can be found in U.S. patent application Ser. No. 10/945,306, filed Sep. 20, 2004, which is hereby incorporated, in its entirety, herein by reference.

In a preferred embodiment, the coated or uncoated paper of paperboard substrate of the present invention has any 2$^{nd}$ Cyan scanner print mottle. However, the 2$^{nd}$ Cyan scanner print mottle may be from 0 to 10, preferably not more than 6, more preferably not more than 5, most preferably not more than 4. The 2$^{nd}$ Cyan scanner print mottle may be 1, 2, 3, 4, 5, 6, 7, 8, 9, and 10, including any and all ranges and subranges therein.

The print mottle of the coated substrate of the present invention is improved by 5%, preferably 20%, more preferably by 30%, and most preferably by 50% compared to that of conventional coated paper substrates not containing expandable microspheres, the composition, and/or the particle of the present invention. A preferred improvement in the print mottle is in the range or from 10 to 20% compared to that of conventional coated paper substrates not containing expandable microspheres, the composition, and/or the particle of the present invention. The substrate of the present invention has a 2$^{nd}$ Cyan scanner print mottle that is improved by 1, 5, 10, 20, 30, 40, 50, 60, 70, 80, 90, 100, 125, 150, 175, 200, 250, 300, 350, 400, 450, 500, 600, 700, 800, 900, and 1000% compared to that of conventional coated paper substrates not containing expandable microspheres, the composition, and/or the particle of the present invention.

In another preferred embodiment of a coating paper, a preferred example of the coating layer comprises a basecoat on a surface of substrate. The basecoat may comprise low density thermoplastic particles dispersed in a polymeric binder. As used herein, "low density thermoplastic particles" are particles formed from thermoplastic or elastic polymers having a density of less than 1.2 Kg/Liter in a dry state including the void air volume. The density is preferably less than 0.8 Kg/Liter, more preferably less than 0.6 Kg/Liter and most preferably from about 0.3 Kg/Liter to about 0.6 Kg/Liter. The low density thermoplastic particles preferably are not expandable and more preferably have a diameter less than about 3 microns, more preferably less than about 2 micron and most preferably from about 0.1 to about 1.0 microns. While we do not wish to be bound to any theory, it is believed that inclusion of the low density thermoplastic particles makes the basecoat more compressible and enhances the beneficial properties of the material. Improved properties include reduced 2$^{nd}$ cyan scanner mottle, enhanced sheet and print gloss and/or enhanced Sheffield and Parker Print smoothness as compared a similar material having the same characteristics except for the presences of the low density thermoplastic particles in the basecoat.

While we do not wish to be bound by any theory, it is also believe that the amount of coating thickness and compressibility (range of compaction) load versus decrease in coating height needed to reduce back trap offset print mottle is directly proportional to the Z-direction non-uniformity of the base paper board's formation at offset printing pressures. For example, offset printing pressures are typically in the range of about 10 kg/sq cm that has been standardized as R (rubber) 10 kg/sq cm of Parker Print Surface roughness (PPS, microns). If these load range is employed, the compressibility of basecoat at the employed load range should "float or cushion" the Z-direction hard fiber to fiber cross-over points to prevent or reduce point to point printing pressure variations. Where present, these variations lead to further variations in ink film transfer initially and in subsequent print units thus unevenly back trapping part of the ink film to subsequent offset blankets (impression cylinder).

Low density thermoplastic particles that can be used may vary widely and include, but are not limited to, hollow polymer plastic pigments and binders having a particle size that is at least about 175 nm. Examples of these are ROPAQUE® HP1055 and AF1353 from Rohm and Haas and the HS 2000NA and HS 3000NA plastic pigments from Dow Chemical Company. The amount of low density thermoplastic particles present in the basecoat may vary widely but is preferably in an amount less than about 30% by weight of the basecoat composition. More preferably, they are present in an amount from about 1 to about 15% by weight of the basecoat composition most preferably in amount from about 2 to about 10% by weight of the basecoat composition and in amount from about 3 to about 7% by weight of the basecoat composition in the embodiments of choice.

The base coat may contain a combination of calcium carbonate (or equivalent thereof) and low density thermoplastic particles. The amount of low density thermoplastic particles may be from 0.5 to 30 wt %, preferably from 1 to 8 wt %, more preferably from 3 to 7 wt %, and most preferably from 4 to 6 wt % based upon the combined total weight of the low density thermoplastic particles and the calcium carbonate (or equivalent thereof).

As another essential component basecoat includes one or more polymeric binders. Illustrative of useful binders are those which are conventionally used in coated papers as for example styrene butadiene rubber latex, styrene acrylate, polyvinyl alcohol and copolymers, polyvinyl acetates and copolymers, vinyl acetate copolymers, carboxylated SBR latex, styrene acrylate copolymers, styrene/butadiene/acrylonitrile, styrene/butadiene/acrylate/acrylonitrile polyvinyl pyrrolidone and copolymers, polyethylene oxide, poly (2-ethyl-2-oxazoline, polyester resins, gelatins, casein, alginate, cellulose derivatives, acrylic vinyl polymers, soy protein polymer, hydroxymethyl cellulose, hydroxypropyl cellulose, starches, ethoxylated, oxidized and enzyme converted starches, cationic starches, water soluble gums, mixtures of water soluble and water-insoluble resins or polymer latexes, and the like may be used. Preferred polymeric binders are carboxylated SBR latexes, polyvinyl alcohol, polyvinyl acetate, styrene/acrylonitrile copolymer, styrene/butadiene copolymer, styrene/acrylate copolymer, and vinyl acetate polymers and copolymers.

Binder latex particles having a sufficient particle size also provide an initial bulking when included with inorganic or organic bulking pigments. Latex particles in general have a particle size from about 100 to about 300 nm for paper coating applications. Latex particles having sufficient size to provide compressibility generally have a particle size that is at least 175 nm. The size of the latex that provides compressibility is directly proportional to the average size of the inorganic and organic pigments used in basecoats. Typically, a source of ground calcium carbonate (GCC) used in paperboard basecoats is HYDROCARB® 60 (from OMYA). This ground calcium carbonate is a wet ball milled product having 60% of its particles less than 2 microns. Conversely, 40% of the particles are equal to or larger than about 2 microns. Preferably, the latex particle size is at least 175 nm for basecoats composed mainly of HYDROCARB® 60 calcium carbonate or similar products. More preferably, the latex particle size is at least 185 nm, and even more preferably, the latex particle size is at least 190 nm.

The sources of calcium carbonate may be mixed at any amount. For example, ground calcium carbonate sources containing 60% of its particles less than 2 microns may be present in an amount that is from 10 to 90 wt % based upon the total weight of the calcium carbonate. The amount of calcium carbonate sources containing 60% of its particles less than 2 microns may be 10, 20, 30, 40, 50, 60, 70, 80, and 90 wt %, based upon the total weight of the calcium carbonate, including any and all ranges and subranges therein.

The sources of calcium carbonate may be mixed at any amount. For example, ground calcium carbonate sources containing 40% of its particles less than 2 microns may be present in an amount that is from 10 to 90 wt % based upon the total weight of the calcium carbonate. The amount of calcium carbonate sources containing 40% of its particles less than 2 microns may be 10, 20, 30, 40, 50, 60, 70, 80, and 90 wt %, based upon the total weight of the calcium carbonate, including any and all ranges and subranges therein.

In the more preferred embodiments of the invention, additional pigment or fillers are employed to improve the properties of the coated paper and paperboard. These additional pigments may vary widely and include those inorganic pigments typically used in the coated paper and paperboard such as silica, clay, calcium sulfate, calcium silicate, activated clay, diatomaceous earth, magnesium silicate, magnesium oxide, magnesium carbonate and aluminum hydroxide. To add additional initial coating bulk, inorganic particles such as precipitated calcium carbonate having bulky structures such as a rosette crystal can also be included. In the most preferred embodiments of the invention, inorganic pigments having a rosette or other bulky structure can be included in the basecoat to make the basecoat have greater initial bulk or thickness. The rosette structure provides greater coating thickness, thus improved coating coverage for a given coat weight. This allows for the dried coating to more easily move in the Z-direction when compressed by the hot soft gloss calenders on coated SBS paperboard machines, and thus to form a level coated surface with a reduced number of low spots. Preferred inorganic pigments include, but are not limited to, precipitated calcium carbonate, mechanically or chemically engineered clays, calcined clays, and other pigment types that function to lower the average density of the coating when dry. These pigments do not provide compressibility to dried basecoats. They synergistically lower average coating density and, raise average coating thickness at a given coat weight so compressible materials, such as larger size binders and hollow plastic spheres, become more efficient in cushioning the Z-direction non-uniformity of the base paperboard's formation from creating point to point variations in printing pressure in the offset printing nip.

Coat weight of the basecoat can vary widely and any conventional coat can be used. Basecoats are generally applied to paper substrates in an amount from about 4 to about 20 gms. The coat weight of the basecoat is preferably from about 6 to about 18 gms and more preferably from about 7 to about 15 gms. The thickness of the basecoat can vary widely and any thickness can be used. Generally, the thickness of the basecoat is from about 1.8 to about 9.0 μm at a minimum, which is figured on the average density and weight ratio of each component in a coating. The thickness of the basecoat is preferably from about 2.7 to about 8.1 μm and more preferably from about 3.2 to about 6.8 μm. When packing factors to dissimilar shapes are taken into account, the average thickness when applied to an impervious surface would be significantly greater than the theoretical values given here. However, because of the rough nature of paperboard in general and the application and metering system used to apply and meter basecoats at an average coat weight of 12 $g/m^2$, the coating thickness at the rough high spots in the paper may be as low as 2-3 microns while valleys between large surface fiber may have coating thickness as great as 10+ microns. Stiff blade metering of the basecoat attempts to provide a level surface to which a very uniform topcoat is applied.

An additional component of material is topcoat. Topcoat comprises one or more inorganic pigments dispersed in one or more polymeric binders. Polymeric binders and inorganic pigments are those typically used in coatings of coated paper and paperboard. Illustrative of useful pigments and binders are those used in basecoat.

Coat weight of topcoat can vary widely and any conventional coat can be used. Topcoat is generally applied to paper substrates in amount from about 4 to about 20 gms. The coat weight of the basecoat is preferably from about 6 to about 18 gms and more preferably from about 7 to about 15 gms. The thickness of topcoat 16 can vary widely and any thickness can be used. Generally, the thickness of the basecoat is from about 1.8 to about 9.0 μm at a minimum, which is figured on the average density and weight ratio of each component in a coating. The thickness of the basecoat is preferably from about 2.7 to about 8.1 μm and more preferably from about 3.2 to about 6.8 μm at a minimum, which is figured on the average density and weight ratio of each component in a coating. The point at which the void volume is filled by binder and additives among all pigments is referred to as the "critical void volume". In the paint industry this point is referred to as the transition from matte to gloss paints.

The coated paper or paperboard of this invention can be prepared using known conventional techniques. Methods and apparatuses for forming and applying a coating formulation to a paper substrate are well known in the paper and paperboard art. See for example, G. A. Smook referenced above and references cited therein all of which is hereby incorporated by reference. All such known methods can be used in the practice of this invention and will not be described in detail. For example, the mixture of essential pigments, polymeric or copolymeric binders and optional components can be dissolved or dispersed in an appropriate liquid medium, preferably water.

The percent solids of the top and basecoat coating formulation can vary widely and conventional percent solids are used. The percent solids of the basecoat coating formulation is preferably from about 45% to 70% because within range excellent scanner mottle characteristics are exhibited by the material with increased drying demands. The percent solids in the basecoat coating formulation is more preferably from about 57 to 69% and is most preferably from about 60% to about 68%. The percent solids in the basecoat coating formulation in the embodiments of choice is from about 63% to 67%.

The coating formulation can be applied to the substrate by any suitable technique, such as cast coating, Blade coating, air knife coating, rod coating, roll coating, gravure coating, slot-die coating, spray coating, dip coating, Meyer rod coating, reverse roll coating, extrusion coating or the like. In addition, the coating compositions can also be applied at the size press of a paper machine using rod metering or other metering techniques. In the preferred embodiments of the invention, the basecoat coating formulation is applied using blade coaters and the topcoat coating formulation is applied using a blade coater or air knife coater. In the most preferred embodiments the basecoat is applied using a stiff blade coater and the topcoat is applied using a bent blade coater or an air knife coater.

The coated or uncoated paper or paperboard substrate is dried after treatment with the coating composition. Methods and apparatuses for drying paper or paperboard webs treated with a coating composition are well known in the paper and paperboard art. See for example G. A. Smook referenced above and references cited therein. Any conventional drying method and apparatus can be used. Consequently, these methods and apparatuses will not be described herein in any great detail. Preferably after drying the paper or paperboard web will have moisture content equal to or less than about 10% by weight. The amount of moisture in the dried paper or paperboard web is more preferably from about 5 to about 10% by weight.

After drying, the coated or uncoated paper or paperboard substrate may be subjected to one or more post drying steps as for example those described in G. A. Smook referenced above and references cited therein. For example, the paper or paperboard web may be calendered to improve the smoothness and improve print mottle performance, as well as other properties of the paper as for example by passing the coated paper through a nip formed by a calender. Gloss calenders (chromed steel against a rubber roll) or hot soft gloss calenders (chromed steel against a composite polymeric surface) are used to impart gloss to the top coated paper or paperboard surface. The amount of heat and pressure needed in these calenders depends on the speed of the web entering the nip, the roll sizes, roll composition and hardness, specific load, the topcoat and basecoat weights, the roughness of the under lying rough paperboard, the binder strength of the coatings, and the roughness of the pigments present in the coating. In general, topcoats contain very fine particle size clays and ground or precipitate calcium carbonate, binder, rheology aids, and other additives. Typically hot soft calenders are 1 m and greater in diameter and are heated internally with very hot heat transfer fluids. The diameter of the heated steel roll is directly dependent on the width of the paper machine. In general, a wider paper machine of 400" as compared to 300" or 250" wide machines requires much larger diameter rolls so that the weight of the roll does not cause sagging of the roll in the center. Hydraulically, internally loaded, heated rolls that are crown compensating are used. Surface temperatures typically used range from 100 to 200° C. The preferable range is 130° C. to 185° C. with nip loads between 20 kN/m and 300 kN/m.

The substrate and coating layer are contacted with each other by any conventional coating layer application means, including impregnation means. A preferred method of applying the coating layer is with an in-line coating process with one or more stations. The coating stations may be any of known coating means commonly known in the art of papermaking including, for example, brush, rod, air knife, spray, curtain, blade, transfer roll, reverse roll, and/or cast coating means, as well as any combination of the same.

The coated substrate may be dried in a drying section. Any drying means commonly known in the art of papermaking and/or coatings may be utilized. The drying section may include and contain IR, air impingement dryers and/or steam heated drying cans, or other drying means and mechanisms known in the coating art.

The coated substrate may be finished according to any finishing means commonly known in the art of papermaking. Examples of such finishing means, including one or more finishing stations, include gloss calendar, soft nip calendar, and/or extended nip calendar.

These above-mentioned methods of making the composition, particle, and/or paper substrate of the present invention may be added to any conventional papermaking processes, as well as converting processes, including abrading, sanding, slitting, scoring, perforating, sparking, calendaring, sheet finishing, converting, coating, laminating, printing, etc. Preferred conventional processes include those tailored to produce paper substrates capable to be utilized as coated and/or uncoated paper products, board, and/or substrates.

The substrate may also include other conventional additives such as, for example, starch, mineral and polymeric fillers, sizing agents, retention aids, and strengthening polymers. Among the fillers that may be used are organic and inorganic pigments such as, by way of example, minerals such as calcium carbonate, kaolin, and talc and expanded and expandable microspheres. Other conventional additives include, but are not restricted to, wet strength resins, internal sizes, dry strength resins, alum, fillers, pigments and dyes.

The expandable microsphere, composition, particle and/or paper substrate of the present invention may be utilized in any and all end uses commonly known in the art for using paper and/or paperboard substrates. Such end uses include the production of paper and/or paperboard packaging and/or articles, including those requiring high and low basis weights in the respective substrates, which can range from envelopes and forms to folding carton, respectively. Further, the end product, article and/or package may have multiple paper substrate layers, such as corrugated structures, where at least one layer contains the expandable microsphere, composition, particle and/or paper substrate of the present invention.

In one embodiment, the article contains a plurality of paper substrates where any and/or all may comprise the expandable microsphere, composition, particle and/or paper substrate of the present invention.

In this specific embodiment, the expandable microsphere, composition, and/or particle are means for bulking paper articles and substrates. However, in this embodiment, any bulking means can be utilized, while the expandable microsphere, composition, particle and/or paper substrate of the present invention is the preferred bulking means. Further, multiple bulking means may be used in the article/package/substrate of the present invention.

Examples of other alternative bulking means may be, but is not limited to, surfactants, Reactopaque, pre-expanded spheres, BCTMP (bleached chemi-thermomechanical pulp), microfinishing, and multiply construction for creating an I-Beam structure in a paper or paper board substrate. Such bulking means may, when incorporated or applied to a paper substrate, provide adequate print quality, caliper, basis weight, etc in the absence harsh calendaring conditions (i.e. pressure at a single nip and/or less nips per calendaring means), yet allow an article to contain a paper substrate having the below physical specifications and performance characteristics.

The article according to this embodiment of present invention may contain a bulking means ranging from 0.01 to 20, preferably from 0.5 to 10, lb per ton of finished product when such bulking means is an additive. The bulking means may be present at 0.01, 0.05, 0.1, 0.25, 0.5, 0.75, 1, 1.5, 2, 2.5, 3, 3.5, 4, 4.5, 5, 6, 7, 8, 9, 10, 11, 12, 13, 14, 15, 16, 17, 18, 19, and 20 lb per ton of finished product when such bulking means is an additive When the article is an envelope and/or forms, the article according to this embodiment of the present invention may contain the paper substrate of the present invention at a caliper ranging from 3.5 to 8 mil, more preferably from 4.2 to 6.0 mil, and most preferably from 4.9 to 5.2 mil.

When the article is an envelope and/or forms, the article according to this embodiment of the present invention may contain the paper substrate of the present invention at a basis weight of from 12 to 30 lb per 1300 square feet, preferably from 16 to 24 lb per 1300 square feet, most preferably from 16 to 22 lb per 1300 square feet.

When the article is an envelope and/or forms, the article according to this embodiment of the present invention may contain the paper substrate of the present invention at a density of from 3.0 to 7.0, more preferably 3.5 to 5.0, most preferably from 3.75 to 4.25 lb/1300 sq. ft. per 0.001 inch thickness.

When the article is an envelope and/or forms, the article according to this embodiment of the present invention may contain the paper substrate of the present invention at a MD Gurley Stiffness of less than or equal to 500 msf, preferably from 150 to 500 msf, more preferably from 225 to 325 msf. The MD Gurley Stiffness must be sufficient enough to accommodate standard converting means, preferable converting means are those commonly known in the art of making envelopes and forms.

When the article is an envelope and/or forms, the article according to this embodiment of the present invention may contain the paper substrate of the present invention at a CD Gurley Stiffness of less than or equal to 250 msf, preferably from 50 to 250 msf, more preferably from 100 to 200 msf. The CD Gurley Stiffness must be sufficient enough to accommodate standard converting means, preferable converting means are those commonly known in the art of making envelopes and forms.

When the article is an envelope and/or forms, the article according to this embodiment of the present invention may contain the paper substrate of the present invention having a Sheffield Smoothness of less than 350 SU, preferably from 150 to 300 SU, most preferably from 175 to 275 SU.

When the article is an envelope and/or forms, the article according to this embodiment of the present invention may be multilayered and contain at least one layer containing the expandable microsphere, composition, particle and/or paper substrate of the present invention where the layer has a width of from 1 to 15 inches and a length from 1 to 15 inches. The width may be 1, 2, 3, 4, 5, 6, 7, 8, 9, 10, 11, 12, 13, 14, and 15 inches, including any and all ranges and subranges therein. The length may be 1, 2, 3, 4, 5, 6, 7, 8, 9, 10, 11, 12, 13, 14, and 15 inches, including any and all ranges and subranges therein.

The article according to the present invention may contain multiple layers containing the expandable microsphere, composition, particle and/or paper substrate of the present invention which may or may not be continuous.

Examples of the article according to the present invention may be an envelope of any standard size and shape generally known in the envelope industry. Further, the article may be an envelope containing a plurality of forms. The envelope of the present invention preferably contains a paper substrate having bulking means, preferable bulking means being the expandable microsphere, composition, particle of the present invention.

Preferably, the article according to the present invention contains a plurality of forms made of the paper substrate having bulking means, preferable bulking means being the expandable microsphere, composition, particle of the present invention.

Most preferably the article is an envelope and a plurality of forms made of the paper substrate having bulking means, preferable bulking means being the expandable microsphere, composition, particle of the present invention.

It is especially preferable that the article of the present invention contain a plurality of forms that is a greater number by at least 1 form than an article that does not contain a substrate having the above mentioned bulking means applied thereto. The article of the present invention has at least one layer (continuous or discontinuous) containing a substrate having the above mentioned bulking means applied thereto. The most preferred bulking means is that of the expandable microsphere, composition, and/or particle applied thereto the substrate contained by the at least one layer of the article. Further, a layer of the article may be a form.

The package of the present invention weighs, on average, equal to or less than 1 ounce, preferably less than one ounce. The package of the present invention has one or a plurality of layers and has a weight whose difference from 1 ounce is an absolute value that is more than that of a conventional package having the same number of layers. Accordingly, more layers may be incorporated into the package of the present invention than that of a conventional package, while maintaining a total weight of the package that is less than 1 ounce.

The package of the present invention weighs, on average, equal to or less than 1 ounce, preferably less than one ounce. The package of the present invention has one or a plurality of layers and has a weight whose difference from 100 ounces is an absolute value that is more than that of a conventional package having the same number of layers. Accordingly, more layers may be incorporated into the package of the present invention than that of a conventional package, while maintaining a total weight of the package that is less than 1 ounce.

The present invention is explained in more detail with the aid of the following embodiment example which is not intended to limit the scope of the present invention in any manner.

EXAMPLES

Example 1

Coated Paper Substrate Containing Expandable Microspheres

A coated paper substrate useful, for example, as folding carton is produced utilizing normal papermaking processes. The paper substrate was calendared under a pressure of 10 psi and then a conventional coating was applied thereto using conventional coating means. After application of the coating layer thereto the substrate, print mottle measurements (both visual and by a much more sensitive and objective standard (Scanning) were taken. The relationship between data from this $2^{nd}$ Cyan scanner mottle system can be correlated to subjective visual perception (using the zero-to-ten guideline) or can be transformed into equivalent mottle values as measured with a Tobias mottle tester from Tobias Associates using the following equation:

$$\text{Tobias}=\text{Scanner Mottle}*8.8+188$$

The methods of describing the procedures and details of setting up of the above-mentioned equation can be found in U.S. patent application Ser. No. 10/945,306, filed Sep. 20, 2004, which is hereby incorporated, in its entirety, herein by reference. Then, in subsequent experiments, expandable microspheres were incorporated into the above conventional process so as to produce papers having 1 wt % and 2 wt % expandable microspheres based on the total weight of the substrate. Two sets of experiments were performed utilizing calendar pressure means equal to 10 and 20 psi, respectively. Results are reported in Table 1 for each.

The results in Table 1 clearly demonstrate that those substrates containing expandable microspheres, when coated, provide a marked improvement in print mottle as measured by the 2" Cyan scanner mottle system.

Example 2

Further Coated Paper Substrates Containing Expandable Microspheres

A coated paper substrate useful, for example, as folding carton is produced utilizing normal papermaking processes. After application of the coating layer thereto the substrate, print mottle measurements (both visual and by a much more sensitive and objective standard (Scanning)) as well as other characteristics were taken (Reported in Table 2). Then, in subsequent experiments, expandable microspheres were incorporated into the above conventional process in amounts of 10, 5, 2, and 1 lb/ton so as to produce papers containing expandable microspheres. Results are reported in Table 2 for each. Further, FIG. 1 shows 2" Cyan scanner mottle as a function of the amount of expandable microspheres added to the papermaking process. Controls 1 and 2 had no expandable microspheres added to the papermaking processes.

TABLE 1

| Print Code | Sample Identification | Calendar Pressure | Expandable Microspheres (wt %) | Impression Setting | Print Order | Approx. Caliper | Caliper at Press | 2nd cyan Mottle Scanner | 2nd cyan Mottle Visual | 6th Cyan Mottle Scanner | 6th Cyan Mottle Visual | Texture | Comments |
|---|---|---|---|---|---|---|---|---|---|---|---|---|---|
| 01 | 12A Low pli | 10 psi | 1% | 10-pt | 20-5 | 20.2 | 20.0 | 9.1 | 4.0 | 4.4 | 1.5 | 4.0 | |
| 02 | 12A High pli | 25 psi | 1% | 20-pt | 20-2 | 18.8 | 20.0 | 8.3 | 4.0 | 4.8 | 2.0 | 4.0 | |
| 03 | 11A Low pli | 10 psi | 2% | 22-pt | 22-3 | 21.6 | 21.5 | 7.6 | 5.0 | 4.0 | 2.0 | 4.0 | |
| 04 | 11A High pli | 25 psi | 2% | 22-pt | 22-2 | 20.7 | 21.0 | 5.7 | 4.0 | 4.9 | 2.0 | 4.0 | |
| 05 | 10C Low pli | 10 psi | 0% | 20-pt | 20-3 | 18.8 | 20.0 | 10.1 | 5.0 | 4.7 | 2.0 | 4.0 | Trial Control |
| 06 | 10C High pli | 25 psi | 0% | 20-pt | 20-4 | 18.3 | 20.0 | 9.9 | 5.0 | 5.3 | 2.0 | 4.0 | Trial Control |

| Print Mottle | Scanner Print Mottle | Visual Print Mottle and Texture Rating |
|---|---|---|
| Scanner mottle in a 1" × 12" (5 × 5 cm) without aqueous overprint coating on a 0.0 (excellent) to 10.0 scale. Visual mottle rates the worst mottle in a 3" × 16" (15 × 40 cm) area, most with overprint coating. Overprint coating may make scanner mottle worse by about 1.0 on most sheets. Texture is rated 1.0 to 5.0 in KCMY overprint. | 0.0-3.9 | 1.0-1.9 = Excellent, above the market norm |
| | 4.0-5.9 | 2.0-2.9 = Good, market norm |
| | 6.0-7.9 | 3.0-3.9 = Fair, below market norm |
| | 8.0-9.9 | 4.0-4.9 = Poor, possible rejection depending upon job being printed |
| | 10.0+ | 5.0+ = Rejectable |

TABLE 2

| | Control 1 (Pre-Trial) | Trial 1 (5 lbs/ton) | Trial 1 (10 lbs/ton) | Control 2 (Pre-Trial) | Trial 2 (1 lb/ton) | Trial 2 (2 lb/ton) |
|---|---|---|---|---|---|---|
| Expancel Dosage (lb/ton) | 0 | 5 | 10 | 0 | 1 | 2 |
| Basis Weight | 255 | 237.4 | 225.6 | 255.1 | 251.2 | 247 |
| Caliper | 23.8 | 24.1 | 23.7 | 24.0 | 23.8 | 24.0 |
| Sheffield (WS) | 27.4 | 9.2 | 9 | 22.7 | 21.5 | 13.0 |
| PPS 10 | 1.61 | 1.5 | 1.55 | 1.47 | 1.48 | 1.42 |
| GM Stiffness | 325 | 284 | 249 | 336 | 309 | 309 |
| Internal Bond | 80 | 72.7 | 58 | 74 | 76 | 81 |
| Print Mottls (2nd Cyan) | 2.6 | 2.17 | 2.1 | 3.67 | 2.87 | 2.7 |
| Basis Weight Reduction (%) | | 6.0 | 11.5 | | 1.53 | 3.18 |

Polyethylenimine (PEI) Adsorption on Microspheres

*Expancel ® microsphere as 40% aqueous slurries
*Slurries added dropwise to 6 wt % PEI ($M_n$ = 10,000, $M_w$ = 25,000 g/mol) solutions
*Vigorous stirring continued for 2 hrs
*Samples washed with 2 L DI $H_2O$ each, then dried using vacuum filtration

| Expancel ® Sample | 820 SLU 40 | 820 SLU 80 | 642 SLX 80 |
|---|---|---|---|
| Adsorption Conditions | | | |
| Amount of 40% Slurry | 7.5 g | 7.5 g | 7.5 g |
| Amount PEI (6%) Solution | 48 g | 48 g | 48 g |
| g dry Particles: g dry PEI | 1:1 | 1:1 | 1:1 |
| Expansion Properties | | | |
| T o.e. (° C.) | 82 | 83 | 90 |
| T o.s. (° C.) | 140 | 125 | 132 |
| V exp (80° C.) (mL) | 1.2 | 2.3 | 1.4 |
| V exp (100° C.) (mL) | ~75 | ~50 | ~65 |

*Expansion properties were not substantially affected by the adsorption of PEI

Surface Charge Reversal Through Post-Aluminization
* Modified process to cover standard expandable particles with layer of cationic colloidal alumina (resulting in reversal of anionic surface charge):
* Prepare suspension of colloidal alumina 28% solids, pH = 4.5)
* Slowly add treated particles (40 wt % slurry) to alumina suspension during vigorous stirring to keep particles dispersed; continue mixing for 1 hr
* Wash particles with large volume of water and dry using vacuum filtration

| | T o.e. (° C.) | T o.s. (° C.) | Expansion (mL) | Zeta Potential (mV) |
|---|---|---|---|---|
| Treated | 75 | 101 | 7.8 | avg = −70.0; SD - 1.5 |
| Aluminized | 78 | 106 | 8.4 | avg = +30.2; SD = 2.4 |

* Cationic surface charge was effectively produced

Experiments

Charge Modification of X-100
- Adsorption of PEI
- Visual observation of particles in slurry in the charge reversal process
- Measurement of Adsorbed PEI
- Measurement of Zeta Potential Retention Analysis
- Britt Jar
- Measurement of Unretained X-100 (Isobutane in GC)

Bulk Development
- Williams handsheets with control and charge modified particles Measurement of System Charge
- Quantification of the effect of unadsorbed PEI and charge modified X-100 on the headbox charge

Experiments

Figure 6:
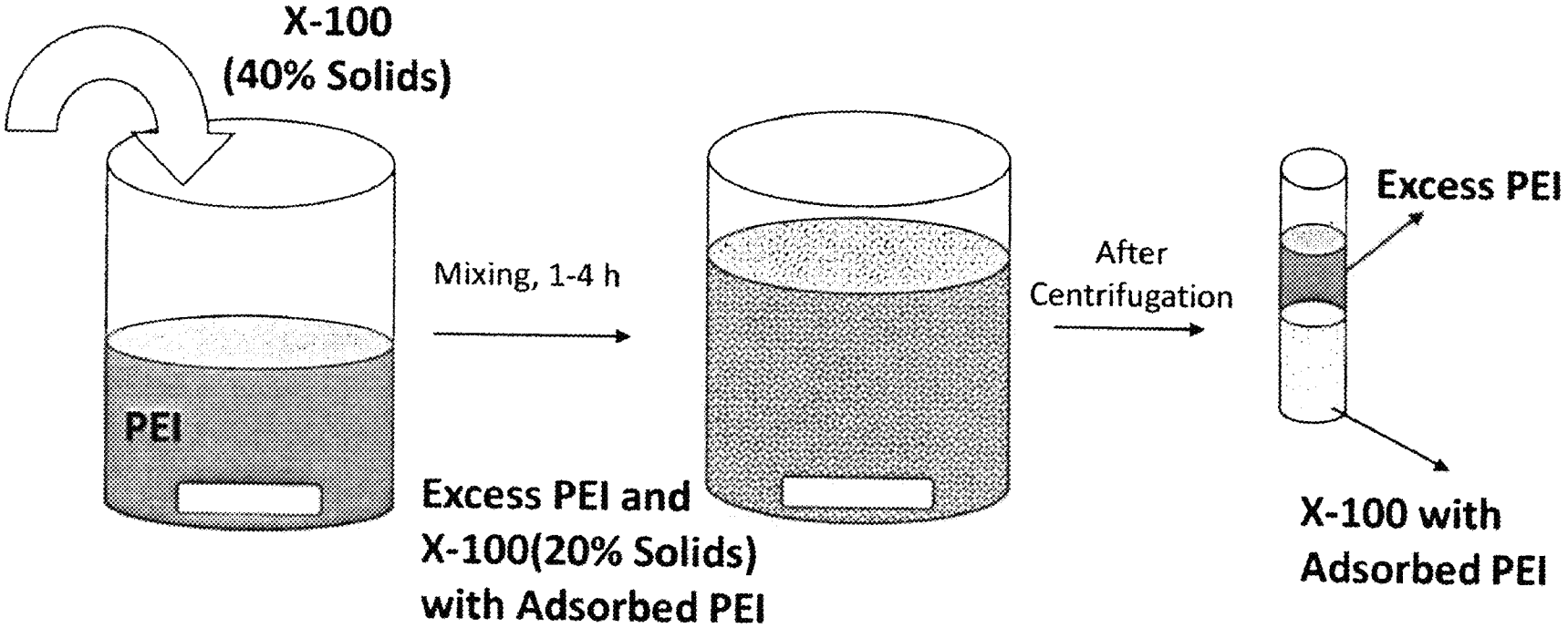
FIG. 6: Diagrams one embodiment of the method of the present invention in which the one embodiment of the composition of the present invention is made.

Charge Modification of X-100
- Materials
  - Low MW PEI (25,000) & High MW PEI (750,000) 642 SLX80
  - Ratio of X-100/PEI varied from 4 to 40
- Methods
  - Mixing time varied 1-4 h
  - Visual observations for incompatibility
  - PEI, X-100 mixture centrifuged and washed to remove excess PET (See FIG. 6)

Adsorption Conditions

| Condition | PEI | X-100/EPI Ratio | Mixing Time (h) | Observation |
|---|---|---|---|---|
| 1 | NA | NA | | |
| 2A | Low MW | 4.00 | 1 | Smooth Mixture |
| 2B | Low MW | 4.00 | 4 | Smooth Mixture |
| 3A | Low MW | 10.00 | 1 | Initial floc became smooth mixture |
| 3B | Low MW | 10.00 | 4 | Initial floc became smooth mixture |
| 4A | Low MW | 20.00 | 1 | Initial floc became smooth mixture |
| 4B | Low MW | 20.00 | 4 | Initial floc - remained flocculated |
| 9 | High MW | 40.00 | 1 | Smooth Mixture |

As used throughout, ranges are used as a short hand for describing each and every value that is within the range, including all subranges therein.

Numerous modifications and variations on the present invention are possible in light of the above teachings. It is, therefore, to be understood that within the scope of the accompanying claims, the invention may be practiced otherwise than as specifically described herein.

All of the references, as well as their cited references, cited herein are hereby incorporated by reference with respect to relative portions related to the subject matter of the present invention and all of its embodiments

What is claimed is:

1. A paper or paperboard substrate, comprising
a plurality of cellulose fibers;
from 0.1 to 5 wt % of a plurality of expandable microspheres; wherein the substrate has a Sheffield smoothness of less than 250 SU as measured by TAPPI test method T 538 om-1;
a basis weight of 20 to 70 lbs/3000 square foot; and
a scanning $2^{nd}$ cyan print mottle of not more than 6, and further comprising at least one ionic compound, wherein the ionic compound is adsorbed onto an outside surface of the expandable microspheres to form particles comprising said expandable microspheres having the ionic compound layered thereon.

2. The substrate according to claim 1, comprising from 0.1 to 3 wt % of a plurality of expandable microspheres.

3. The substrate according to claim 1, comprising from 0.1 to 2 wt % of a plurality of expandable microspheres.

4. The substrate according to claim 1, further comprising at least one coating layer.

5. The substrate according to claim 1, wherein the coating layer comprises at least one top coat and at least one base coat.

6. The substrate according to claim 1, wherein the Sheffield Smoothness is less than 250 SU and the scanning print mottle is less than 6 after calendaring said substrate, as measured by TAPPI test method T 538 om-1.

7. The substrate according to claim 1, wherein the substrate has a Parker Print Surface Smoothness of from about 1.0 to 0.5 as measured by TAPPI test method T 555 om-99.

8. An article, comprising the substrate according to claim 1.

9. The article according to claim 8, wherein the article is a folding carton.

10. The composition according to claim 1, wherein said ionic compound is at least one compound selected from the group consisting of an organic and Inorganic Ionic compound.

11. The composition according to claim 1, wherein said ionic compound is at least one polyorganic compound.

12. The composition according to claim 1, wherein said ionic compound is at least one polyamine compound.

13. The composition according to claim 1, wherein said ionic compound is crosslinked, branched, or combination thereof.

14. The composition according to claim 1, wherein said Ionic compound is at least one polyethyleneimine compound.

15. The composition according to claim 1, wherein said ionic compound is at least one polyethyleneimine compound having a molecular weight of at least 600 weight average molecular weight.

16. The composition according to claim 1, wherein said Ionic compound is at least one polyethyleneimine compound having a molecular weight of from 600 to 40,000 weight average molecular weight.

17. The composition according to claim 1, wherein said Ionic compound is cationic.

18. The composition according to claim 1, wherein said ionic compound comprises at least one member selected from the group consisting of alumina and silica.

19. The composition according to claim 1, wherein said ionic compound comprises a colloid comprising at least one member selected from the group consisting of silica, alumina, tin oxide, zirconia, antimony oxide, Iron oxide, and rare earth metal oxides.

20. The composition according to claim 1, wherein said ionic compound comprises a sol comprising at least one member selected from the group consisting of silica, alumina, tin oxide, zirconia, antimony oxide, iron oxide, and rare earth metal oxides.

21. The composition according to claim 1, wherein the outside surface is bound to the ionic compound.

22. The composition according to claim 1, wherein the outside surface is non-covalently bound to the ionic compound.

23. The composition according to claim 1, wherein the outside surface is anionic.

24. The substrate according to claim 1, wherein the basis weight is 30 to 70 lbs/3000 square foot.

25. The substrate according to claim 4, wherein the coating layer has a coat weight from about 4 to about 20 gms.

26. The substrate according to claim 4, wherein coating layer comprises a basecoat having a coat weight from about 4 to about 20 gms.

27. The substrate according claim 4, wherein the coating layer comprises a topcoat having a coat weight from about 4 to about 20 gms.

* * * * *